United States Patent [19]

White et al.

[11] 4,408,199

[45] Oct. 4, 1983

[54] IDEOGRAM GENERATOR

[75] Inventors: Douglass A. White; Susan J. Moore; David F. Clark, all of Fairfield, Iowa

[73] Assignee: Global Integration Technologies, Inc., Fairfield, Iowa

[21] Appl. No.: 186,580

[22] Filed: Sep. 12, 1980

[51] Int. Cl.[3] ..... G09G 1/16

[52] U.S. Cl. ..... 340/731; 340/723; 340/728; 340/751; 382/61

[58] Field of Search ..... 340/146.3 AH, 731, 723, 340/728, 744, 748, 750, 751

[56] References Cited

U.S. PATENT DOCUMENTS

| | | | |
|---|---|---|---|
| 3,786,478 | 1/1974 | King, Jr. | 340/728 |
| 4,097,846 | 6/1978 | Lewis | 340/146.3 AH |
| 4,153,896 | 5/1979 | White | 340/146.3 AH |
| 4,168,489 | 9/1979 | Ervin | 340/146.3 AH |
| 4,181,973 | 1/1980 | Tseng | 340/790 |
| 4,193,119 | 3/1980 | Arase et al. | 340/790 |
| 4,254,409 | 3/1981 | Busby | 340/723 |
| 4,294,550 | 10/1981 | Wang . | |
| 4,314,244 | 2/1982 | Demke et al. | 340/731 |
| 4,327,421 | 4/1982 | Wang . | |

OTHER PUBLICATIONS

VC1A Chinese Input-Output System Brochure, Teco Electric and Machinery Co., Taipei, Taiwan.
Synotronic CS4000 Machine Brochure (in Chinese).
Wang Ideographic Word Processor Brochure.
*Microprocesser and Microcomputer News*, Oct. 1980, p. 25 "Multitech Introduces High Performance 'Dragon' Chinese I/O Computer" by George Huang.
EDP Chinese Terminal (undated)—EDP Taiwan Incorporated.
Chinese Publication.
Chinese Publication.

*Primary Examiner*—Marshall M. Curtis
*Attorney, Agent, or Firm*—Phillips, Moore, Lempio & Finley

[57] ABSTRACT

A computer is used to generate ideograms such as Chinese characters from an input of coded signals. The input device may be a standard ASCII keyboard having forty-four (44) keys with a shift key giving an eighty-eight (88) character input set. Combinations of two key strokes result in the ideogram being made ready for output, while certain other key strokes serve to combine one or more ideograms to generate more complex characters. The system will produce in excess of fifty thousand (50,000) characters with an average of less than four key strokes per character.

21 Claims, 17 Drawing Figures

FIG _ I

| COLUMN | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| BIT PATTERN $b_8$ | 0 | 0 | 0 | 0 | 0 | 0 | 0 | 0 | 1 | 1 | 1 | 1 | 1 | 1 | 1 | 1 |
| $b_7$ | 0 | 0 | 0 | 0 | 1 | 1 | 1 | 1 | 0 | 0 | 0 | 0 | 1 | 1 | 1 | 1 |
| $b_6$ | 0 | 0 | 1 | 1 | 0 | 0 | 1 | 1 | 0 | 0 | 1 | 1 | 0 | 0 | 1 | 1 |
| $b_5$ | 0 | 1 | 0 | 1 | 0 | 1 | 0 | 1 | 0 | 1 | 0 | 1 | 0 | 1 | 0 | 1 |
| ROW $b_4$ $b_3$ $b_2$ $b_1$ | | | | | | | | | | | | | | | | |
| 0 0 0 0 0 | | | | | | | | | | | SP | Ø | @ | P | | |
| 1 0 0 0 1 | | | | | | | | | | | ! | 1 | A | Q | | |
| 2 0 0 1 0 | | | | | | | | | | | " | 2 | B | R | | |
| 3 0 0 1 1 | | | | | | | | | | | # | 3 | C | S | | |
| 4 0 1 0 0 | | | | | | | | | | | $ | 4 | D | T | | |
| 5 0 1 0 1 | | | | | | | | | | | % | 5 | E | U | | |
| 6 0 1 1 0 | | | | | | | | | | | & | 6 | F | V | | |
| 7 0 1 1 1 | | | | | | | | | | | ' | 7 | G | W | | |
| 8 1 0 0 0 | | | | | | | | | | | ( | 8 | H | X | | |
| 9 1 0 0 1 | | | | | | | | | | | ) | 9 | I | Y | | |
| A 1 0 1 0 | | | | | | | | | | | * | : | J | Z | | |
| B 1 0 1 1 | | | | | | | | | | | + | ; | K | [ | | |
| C 1 1 0 0 | | | | | | | | | | | , | < | L | \ | | |
| D 1 1 0 1 | | | | | | | | | | | - | = | M | ] | | |
| E 1 1 1 0 | | | | | | | | | | | . | > | N | ^ | | |
| F 1 1 1 1 | | | | | | | | | | | / | ? | O | — | | |

ASCII INPUT WITH LEADING ONE IN BIT POSITION EIGHT $b_8$ $b_7$ $b_6$ $b_5$ $b_4$ $b_3$ $b_2$ $b_1$

ASCII CODE

FIG_2

| COLUMN | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| $b_8$ | 0 | 0 | 0 | 0 | 0 | 0 | 0 | 0 | 1 | 1 | 1 | 1 | 1 | 1 | 1 | 1 |
| $b_7$ | 0 | 0 | 0 | 0 | 1 | 1 | 1 | 1 | 0 | 0 | 0 | 0 | 1 | 1 | 1 | 1 |
| $b_6$ | 0 | 0 | 1 | 1 | 0 | 0 | 1 | 1 | 0 | 0 | 1 | 1 | 0 | 0 | 1 | 1 |
| $b_5$ | 0 | 1 | 0 | 1 | 0 | 1 | 0 | 1 | 0 | 1 | 0 | 1 | 0 | 1 | 0 | 1 |
BIT PATTERN
| ROW | $b_4$ | $b_3$ | $b_2$ | $b_1$ |
|---|---|---|---|---|
| 0 | 0 | 0 | 0 | 0 |
| 1 | 0 | 0 | 0 | 1 |
| 2 | 0 | 0 | 1 | 0 |
| 3 | 0 | 0 | 1 | 1 |
| 4 | 0 | 1 | 0 | 0 |
| 5 | 0 | 1 | 0 | 1 |
| 6 | 0 | 1 | 1 | 0 |
| 7 | 0 | 1 | 1 | 1 |
| 8 | 1 | 0 | 0 | 0 |
| 9 | 1 | 0 | 0 | 1 |
| A | 1 | 0 | 1 | 0 |
| B | 1 | 0 | 1 | 1 |
| C | 1 | 1 | 0 | 0 |
| D | 1 | 1 | 0 | 1 |
| E | 1 | 1 | 1 | 0 |
| F | 1 | 1 | 1 | 1 |
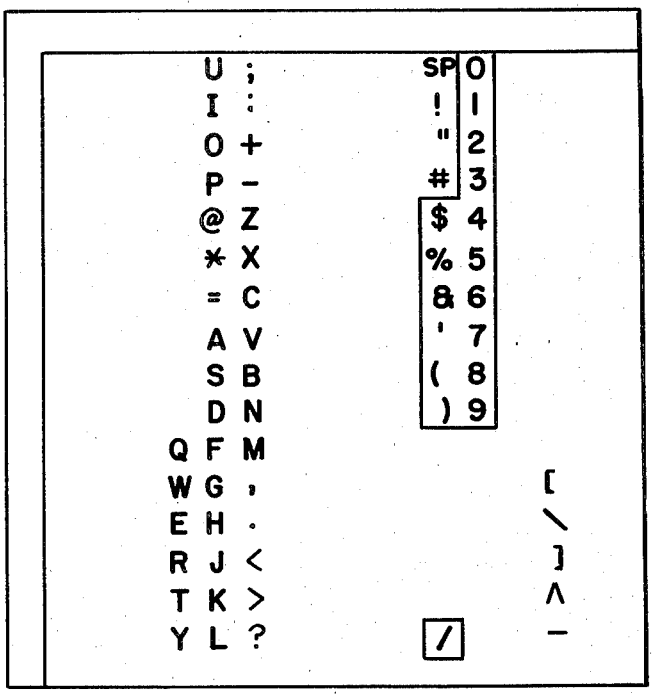
INTERNAL REPRESENTATION AFTER CONVERSION
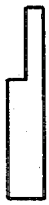
REPRESENTS SHAPE OPERATORS
FIG_3

IDEOGRAM GENERATOR

TECHNICAL FIELD

This invention relates to the generation of two-dimensional characters such as ideograms by a computer system. In particular it relates to the generation of a character set such as the Oriental character set from a forty-four (44) key keyboard utilizing standardized coded signals for input. The invention may also be used for the generation of characters in other ideographic character sets such as hieroglyphics.

BACKGROUND ART

The ideographic character set used by the Chinese, Japanese, and Koreans to represent in a written form their spoken languages, consists of many thousands of characters. In fact, one of the characteristics of the character set is the capability of combining two or more characters in order to form a new character. Nevertheless, each character is comprised of one or more of five fundamental stroke shapes, which are :

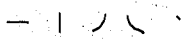

These fundamental strokes may be apparent in variations thereof from simple to complex and from a non-serifed to serifed, such as:

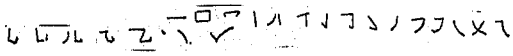

In order to construct Oriental characters on a cathode ray tube or an output device such as a printer, it is necessary to first develop a dictionary of characters, and secondly to encode the characters in a form that is compatible with the output device. One of the earlier attempts at automating a character set is found in the Japanese typewriter, which has upwards of six hundred (600) keys with each key representing a unique character. More recently, various computer manufacturers have placed on the market character generators capable of producing a family of characters. These systems have utilized either a large keyboard similar to the Japanese keyboard, or a number pad wherein the operator utilizes a plurality of number codes, each representing a Japanese character. While these systems are operable, they require a great deal of experience to operate and further, the number of key strokes, particularly in the number pad system, may be excessive. For example, a character set having fifty thousand (50,000) characters would require at least five key strokes on a ten-key keyboard in order to obtain any single character. Reduction of the number of characters under the five figure mark, that is, below ten thousand (10,000) characters, may severely limit the use of the system to rather simple and non-technical applications. It is for this reason that many of the present systems have proved inadequate.

Another problem presented in automating the production of an Oriental character system is the lack of a standard hierarchical order of the characters. There are several schemes presently known to "sort" the character set, thereby facilitating dictionary lookup. One of the more popular systems used by some libraries is the "four corner system" wherein the characters are described by numbers assigned to certain stroke configurations such as set forth above and found at each corner of the generally square character. Even though this system is in use, the system does produce numerous ambiguous codes. A simpler system assigns two digits to each of three corners and is known as the "three corner system." This system permits approximately one hundred thousand (100,000) possible characters to be encoded with six-digit numbers. Nevertheless, it has been found that approximately ten percent (10%) of the numbers turn out to be ambiguous. The ambiguities plus the large size of the input string (six characters) would slow an automated operation excessively.

A two corner system utilizes a scheme similar to the aforedescribed four corner numbers plus a phonetic sign derived from the pronunciation of the characters. Nevertheless, some ambiguities remain, although the number of key strokes per character may be reduced to approximately three with two shift keys. The difficulty with this system is that the operator must be familiar with the phoneticized dialect in order to operate the system.

For many years, the Orientals have used the "telegraph code" which is an arbitrary assignment of numbers from zero (0) to 9,999 to various characters in the dictionary. It can be readily seen that the vocabulary is limited to the 9,999 characters, and further, the encoding of the message may pose serious problems when technical terms or the like must be transmitted. This code is used, as the name implies, in the telegraph system in the Orient.

Various other systems have been developed based on phonetics using an English keyboard or a larger keyboard controlled with numerous shift keys. Again, these pose problems to one who is not familiar with the pronunciation and the phonetics of the character set.

More recently, a component method has been developd. In this system, the characters are built up from simpler elements. The basic building blocks are the five basic strokes listed above. The problem with this system is the number of key strokes necessary for a character in order to develop an adequate vocabulary. In particular, in an automated system the various components tend to be distorted out of proportion when combining two or more components to make a final character. For example, a combination of three components without compression results in either horizontally or vertically elongated characters or a triangular shaped character. As well known, most of the Chinese characters sets are formed generally in a square shape, thus, the "component formed" character without some sort of manipulation of the individual components, is inadequate to the user from the aesthetic point of view and consequently, may be harder to read. Nevertheless, the component system has proved popular in recent years in categorizing or hierarchically sorting the Chinese character set.

Using the component system, as suggested above, permits the linguist to sort out basic components of the character by one of the hierarchical methods set forth above. In addition, a completely different method was suggested by two Russians, Rosenberg and Kolokolov, and applied in dictionaries by Oshanin. This classification system uses the five basic forms as set forth above as they occur in the lower right hand corner of the character. Thus, it could be likened to a "one corner" system. With a hierarchical system such as this, Chinese character systems may be readily sorted. As noted above, other schemes have been developed which also achieve this end; however, none has been universally accepted.

The actual structure of an ideogram such as a Chinese character is important to any system that develops or generates characters in some mechanical or electronic way. In particular, the Chinese character system is built of pictograms which represent, albeit somewhat fancifully, the item being described. For example, the Chinese character for an urn or tripod consists of a figure having four legs and a table-like top which is representative of the urn itself. A second type of character used by the Chinese is the ideogram, which may be a combination of two pictograms or two other ideograms. The third generalized form of Chinese character is comprised of a radical or root component that indicates the general semantic category of the word, for example, a plant, a tree, or a bird, and a phonogram or phonetic component that indicates the general pronunciation of the word and thereby specifies which member of the semantic category is being represented. Thus, if one looks at various types of birds such as the oriole, the chicken, or the seagull, the root component for a bird is found in each case. Unfortunately, the relative position of the components is unpredictable as is the pronunciation. Nevertheless, such complexities are not necessarily limiting to one generating such characters, particularly if the generation is from textual material presented to the operator. This situation is quite common in a library environment such as the cataloguing of books, or in the transmission of messages from one locale to another. In both instances, the clerical function of transcribing the textual matter to some sort of an automated device does not necessarily require that the operator have a vast store of knowledge about the makeup of the various characters. Consequently, it has been possible to devise and use a scheme or system for categorizing characters such as the "one corner system" suggested here. Once one becomes familiar with the hierarchical sort order of a basic character set, other characters can be developed therefrom.

While, on the surface, this appears to be a relatively simple task, when the task is automated it becomes more complex as the characters may be formed in many different ways. For example, one character may be above another, or one character may be to the left or the right of another. Furthermore, the character may be a representation of three or more other separate characters.

In the past, attempts to automate a Chinese character set on a computer have generally utilized a complete matrix of each character available for output. It is readily apparent that such an approach to an automated character set or means for generating the character set is very wasteful as far as the core storage in the computer is concerned. Accordingly, it is appropriate to utilize off-line storage in such systems. Therefore, a scheme which not only reduces the number of stored characters, but also reduces the space utilized to store characters is appropriate. Further, the reduction of dictionary size reduces access time to search and retrieve a particular stored character.

Finally, present systems fall short in that the compression of characters necessary to combine two or more characters has proved inadequate.

Accordingly, this invention is directed to overcoming one or more of the problems as set forth above.

DISCLOSURE OF THE INVENTION

In one aspect of this invention, a computer system includes input means for receiving coded sequences of signals. It further includes a processor for storing a control program and output means responsive to the control program for displaying two-dimensional shapes. Storage means are included with the computer for hierarchically storing a set of ideograms. Also included with the computer are means responsive to one of the coded sequences for providing to the output for display thereon one of the ideograms. The improvement is a means responsive to the control program for selectively reducing at least one dimension of at least one of the ideographic characters and means responsive to the control program for placing the one reduced ideographic character adjacent the second ideographic character.

Also included is a method for inputting a character string into a computer system, retrieving a stored coded sequence in response to the inputted character string, constructing an ideogram from the retrieved sequence string, and displaying an ideogram for visual recognition.

BRIEF DESCRIPTION OF THE DRAWINGS

FIG. 2 is the bit code for the ASCII representation of a character set utilized for input to this system.

FIG. 3 is a bit configuration of the characters after conversion by the invention.

BEST MODE FOR CARRYING OUT THE INVENTION

Figure 1:
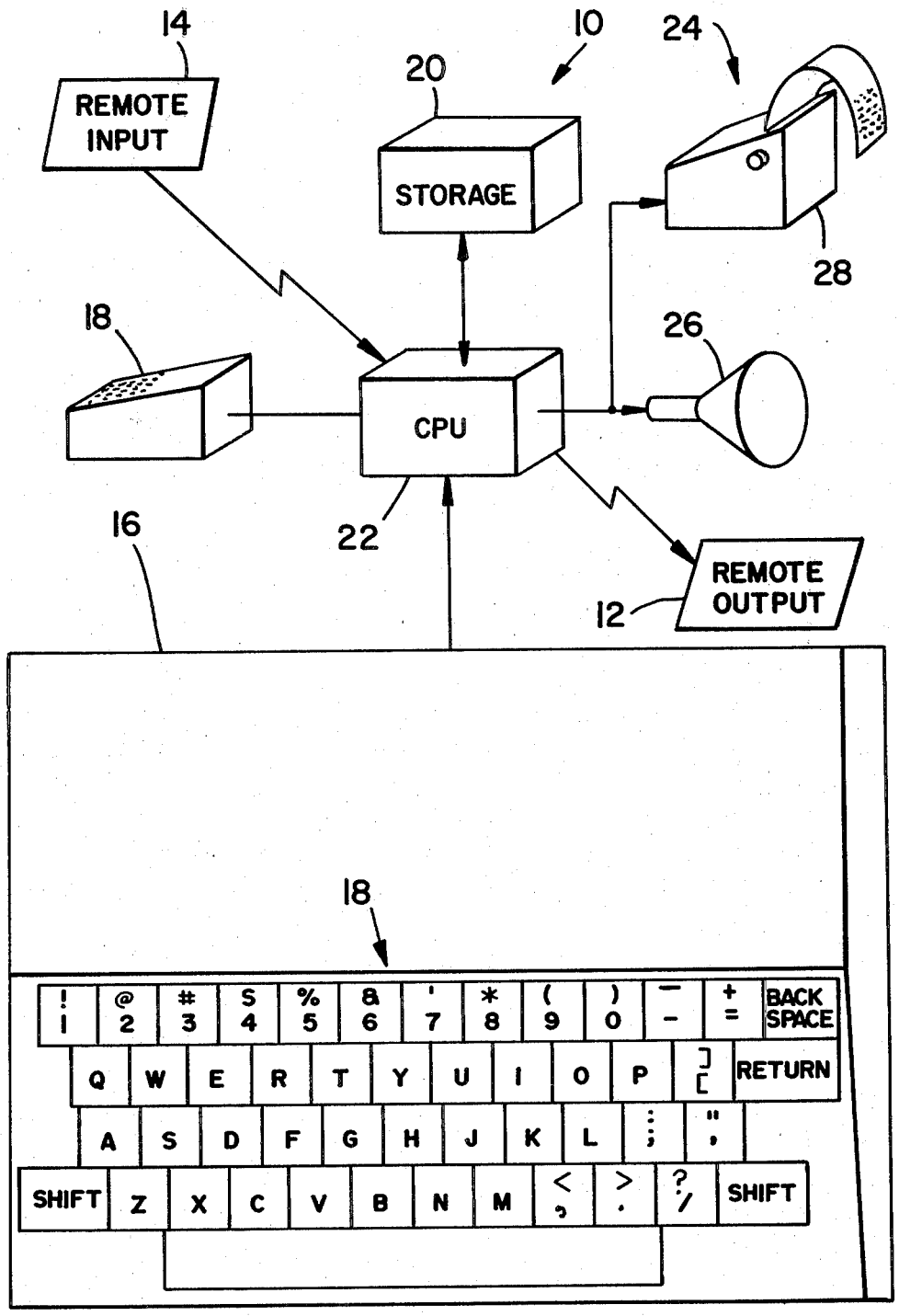
FIG. 1 is a schematic of an embodiment of the present invention showing representative computer elements which may be used to practice this invention.

Referring to FIG. 1, a representative computer system 10 is shown. Computer system 10 may be any of the currently commercially available computer systems having a moderate sized internal memory. It has been found that a memory size of 64k bytes is adequate to support this system. A representative computer that has been found adequate to support this system is the Apple II computer manufactured by Apple Computer, Inc. of Cupertino, Calif. It should be noted that at least two of the units of computer system 10 shown in FIG. 1 are not necessary to the operation of this system. These two units are the remote output 12 and the remote input 14. More will be said about these two components in the ensuing discussion.

Computer system 10 is comprised of an input device 16 which is illustrated as a keyboard entry having a standard English alphabet keyboard 18 that includes forty-four (44) unique character keys and a shift key thereby giving the capability of eighty-eight (88) unique characters. Other input devices that will provide input data to computer system 10 is a standard form, in particular, the American National Standard Code for Information Interchange, hereinafter referred to as ASCII, character set may be utilized. Computer system 10 also includes a processor 22 which performs all the functions found in general purpose computers, such as logic operations and arithmetic operations. It should be noted that in general arithmetic operations are not necessary to the function of this system.

The computer system 10 should also include some off-line storage 20 which may take the form of any appropriate storage device such as insertable discs, tapes, drums, or the like. Storage 20 may also take the form of a virtual memory such as is now present in many of the commercially available computer systems.

Computer system 10 also includes output means 24 which may be in the form of a cathode ray tube 26 or a printer 28. It is to be understood that the system as depicted in FIG. 1 and described above is representative of an integral component of this system. As previously stated, any appropriate computer system having at least an input device, a processor, some storage, and an output device, will suffice. The minimum storage necessary to operate the system is dependent, to a great degree, upon the extent of the programming and the size of the character set. If used, remote input 14 and the remote output 12 may be physically separated from processor 22 and communicate therewith by any appropriate communications means. Further discussion of these two devices is not necessary as the nature of such devices is well known to those skilled in the art.

As previously noted, keyboard 18 is depicted as having an English character set. This depiction is for convenience's sake only since other characters may be depicted on the keyboard. For example, when this invention is used for an Oriental language, it may be appropriate to utilize appropriate ideograms or pictograms as symbols on the keyboard. Nevertheless, as is usual in most computer systems, actuation of one of the keys in keyboard 18 results in the generation of a string of signals which are communicated to the processor 18. This string of signals may be in a serial form or in a parallel form. A generally accepted worldwide standard for such signals is the ASCII character set which is illustrated in FIG. 2. It should be noted that the characters depicted in FIG. 2 again are English characters. It is the coding structure associated with these characters that is important. For example, the numeral "1" has a bit pattern starting with the high order bit of 0110001, while the letter "A" has a bit pattern of 1000001. It should be understood that the ASCII code as depicted in FIG. 2 utilizes seven bits for intelligence, giving a character set of 128 unique combinations of ones and zeros.

In recent years, some computers and computer systems have been built using an eight bit code rather than a seven bit code. For example, the Apple II computer which has been used in this invention utilizes eight bits. However, no intelligence is transmitted with this bit. In order to represent an eight bit code, the drawings of the codes shown in FIGS. 2 and 3 include an eight bit. This eighth bit is used in this invention to facilitate the establishment of a hierarchy of stored characters stored dependent upon the shape of the character. Since the simplest shapes are inputted from the keyboard such as the ASCII keyboard, the system utilizes a conversion to convert the ASCII character from the keyboard to an hierarchical character as depicted in FIG. 3.

The relationship between the ASCII input character or whatever character is used on the keyboard is best shown by Appendix 1 to this application, which graphically displays a representative character set available for output from this computer system. For clarity's sake, it should be pointed out that the characters depicted in Appendix 1 are Chinese characters, each being either a pictogram, an ideogram, or a phonogram. For convenience's sake, these individual characters will be called ideograms. Further, the combination of two or more of these ideograms or characters will also be called an ideogram. In summary, ideogram will be used as a generic term for the Chinese characters, at least as far as this invention is concerned. Referring now to Appendix 1, it can be seen that the set of ideograms depicted therein is in a matrix format wherein the rows and columns follow the order generally of the keyboard depicted in FIG. 1 with the upper lefthand corner of the matrix being in correspondence with the two ASCII characters "QQ." Column 2 of row 1 is thus "QW" while column 3 is "QE." Similarly, row 2 of column 1 is "WQ" and row 3 is "EQ." It can be seen that the hierarchical order of the keyboard character set (that is, "QWERT") does not correspond to the hierarchical order of the bit pattern as shown in FIG. 2. Thus, if one starts numbering from the colon (:) which is found at column B, row A and which has an ASCII code of 0111010, the character "Q" which has an ASCII code of 1010001 is the twenty-third character in a sequence when the bits are arranged in ascending order. Referring to Appendix 1, it can be seen that the simplest character is a horizontial line which is located in the upper lefthand corner of the matrix. The ASCII command to obtain this simple character is the alphabetic characters "QQ."

In order to establish a degree of order to the ideographic set, the character "Q" is internally converted by this system to a colon (:) as indicated in FIG. 2. Concurrently, in the internal operation of the computer, the leading bit or the eight bit, which ordinarily is represented by a "1," is converted to a "0" (zero). Thus, the whole character string is shifted leftwardly on the matrix as shown in FIG. 3 so that an inputted "Q" when representing an ideogram is converted to the bit pattern normally representing a colon (:). The "W" is likewise converted to the bit pattern normally representing a semicolon (;). The remaining keyboard characters are similarly converted and reordered as shown in FIG. 3.

The system is designed such that each of the characters depicted in Appendix 1 is represented internally in the computer by a particular bit pattern. It has been found from experience that these patterns are best represented on output devices such as cathode ray tube 26 or printer 28 by a dot matrix. Further, by experimentation it has been found that a twenty-one by twenty-one dot matrix will adequately represent the characters shown in Appendix 1 and further permit compression either vertically or horizontally of these characters without loss of intelligence in the character. For purposes of this specification the commonly-used term "pixel", a combined abbreviation of the words picture and element, will be considered to be the smallest discrete element of an ideogram as it is displayed on an output device. Thus, in using the dot-matrix character presentation, a discrete dot is a pixel. Larger dot matrixes such as thirty-six by thirty-six could also be used; however, the larger the matrix, the more storage space required per character. Hence, there is a tradeoff between intelligence depicted by the character and storage space required. Internal representation of the character by a twenty-one by twenty-one dot matrix would usually be accomplished by twenty-one rows each having three eight bit bytes. Thus, each row can be represented by twenty-four bits of information, twenty-one bits to represent the row of twenty-one dots and three unused bits. Therefore, the internal representation of each character would be twenty-one rows of three bytes each, for a total of sixty-three bytes. As can be seen in Appendix 1, the suggested character matrix is thirty-three by thirty-seven, making a total of over 1200 characters.

Even though it should be readily apparent to those skilled in the art that the character matrix could easily be expanded to forty-four by forty-four, thus, utilizing each character of the keyboard, the 1200 characters depicted in Appendix 1 have proven suffficient to generate an ideographic character set far and above the 1200 characters. In particular, the characters are combined to form additional characters, as has been previously mentioned. Should each character be represented by the sixty-three bytes as indicated above, the storage requirement for the character set depicted in Appendix 1 would normally require over seventy-five thousand (75,000) bytes of storage. This invention utilizes a coding system to store an ideographic character such as is shown in FIGS. 6–9 and 12–14 in less than sixty-three bytes for each character. Tables 1 and 2 explain this system:

TABLE 1

Composition of Byte
1 - bit set to 1
Ø - bit set to Ø
X - bit either 1 or Ø

FIRST BYTE

| Bit | 7 | 6 | 5 | 4 | 3 | 2 | 1 | 0 | | |
|---|---|---|---|---|---|---|---|---|---|---|
| | Ø | X | X | X | X | X | X | X | single byte row | |
| | 0 | 0 | 0 | X | X | X | X | X | double byte row | |
| | 1 | X | X | X | X | X | X | X | three byte row | |
| | X | 0 | 1 | X | X | X | X | X | row not repeated | |
| | X | 1 | 0 | X | X | X | X | X | row repeated once | use with |
| | X | 1 | 1 | X | X | X | X | X | row repeated twice | single or three byte rows |
| | 0 | 0 | 0 | 0 | 0 | 0 | 0 | 0 | double byte row - no repeats | |
| | 0 | 0 | 0 | 0 | 0 | 0 | 0 | 1 | double byte row - 1 repeat | |
| | 0 | 0 | 0 | 0 | 0 | 0 | 1 | 0 | double byte row - 2 repeats | |
| | 0 | 0 | 0 | 1 | 1 | 1 | 1 | 1 | double byte row - more than 2 repeats | |
| | 1 | 0 | 0 | X | X | X | X | X | "three" byte row repeated more than twice (repeat information in a fourth byte) | |

SECOND BYTE*

| Bit | 7 | 6 | 5 | 4 | 3 | 2 | 1 | 0 | |
|---|---|---|---|---|---|---|---|---|---|
| | 0 | 0 | 0 | 0 | X | X | X | X | used for 3 or more repeats of first byte only |
| | X | X | X | X | 1 | 1 | 1 | 1 | row repeated 3 times |
| | X | X | X | X | 0 | 0 | 0 | 1 | row repeated 4 times |
| | X | X | X | X | 0 | 0 | 1 | 0 | row repeated 5 times |
| | X | X | X | X | 0 | 0 | 1 | 1 | row repeated 6 times |
| | X | X | X | X | 0 | 1 | 0 | 0 | row repeated 7 times |
| | X | X | X | X | 0 | 1 | 0 | 1 | row repeated 8 times |
| | X | X | X | X | 0 | 1 | 1 | 0 | row repeated 9 times |
| | X | X | X | X | 0 | 1 | 1 | 1 | row repeated 10 times |
| | X | X | X | X | 1 | 0 | 0 | 0 | row repeated 11 times |
| | X | X | X | X | 1 | 0 | 0 | 1 | row repeated 12 times |
| | X | X | X | X | 1 | 0 | 1 | 0 | row repeated 13 times |
| | X | X | X | X | 1 | 0 | 1 | 1 | row repeated 14 times |
| | X | X | X | X | 1 | 1 | 0 | 0 | row repeated 15 times |
| | X | X | X | X | 1 | 1 | 0 | 1 | row repeated 16 times |
| | X | X | X | X | 1 | 1 | 0 | 0 | rule exception |
| | X | X | X | X | 0 | 0 | 0 | 0 | less than 3 repeats |

*Also fourth byte in a multiple repeat three byte situation.

TABLE 2

Content of Row

FIRST BYTE

| Bit | 7 | 6 | 5 | 4 | 3 | 2 | 1 | 0 | |
|---|---|---|---|---|---|---|---|---|---|
| | 0 | X | X | 0 | 0 | 0 | 0 | 0 | single byte - all cols. Ø |
| | 1 | X | X | 0 | 0 | 0 | 0 | 0 | three byte row - cols. 1–5 are Ø |
| | 0 | X | X | 0 | 1 | 1 | 1 | 1 | cols. 3–19 are 1 |
| | 0 | X | X | 0 | 0 | 1 | 1 | 1 | cols. 5–17 are 1 |
| | 0 | X | X | 0 | 0 | 0 | 1 | 1 | cols. 7–15 are 1 |
| | 0 | X | X | 0 | 0 | 0 | 0 | 1 | cols. 9–13 are 1 |
| | 0 | X | X | 0 | 1 | 1 | 1 | 0 | cols. 10–12 are 1 |
| | 0 | X | X | 1 | 1 | 0 | 0 | 0 | cols. 3, 4, 18, 19 are 1 |
| | 0 | X | X | 0 | 1 | 1 | 0 | 1 | cols. 4, 5, 17, 18 are 1 |
| | 0 | X | X | 0 | 1 | 1 | 0 | 0 | cols. 5, 6, 16, 17 are 1 |
| | 0 | X | X | 1 | 0 | 0 | 1 | 1 | cols. 6, 7, 15, 16 are 1 |
| | 0 | X | X | 0 | 0 | 1 | 1 | 0 | cols. 7, 8, 14, 15 are 1 |
| | 0 | X | X | 0 | 1 | 0 | 1 | 1 | cols. 8, 9, 13, 14 are 1 |
| | 0 | X | X | 0 | 0 | 1 | 0 | 1 | cols. 9, 10, 12, 13 are 1 |
| | 0 | X | X | 0 | 1 | 0 | 0 | 0 | cols. 3, 4, 11, 18, 19 are 1 |
| | 0 | X | X | 1 | 0 | 0 | 0 | 1 | cols. 4, 5, 11, 17, 18 are 1 |
| | 0 | X | X | 0 | 0 | 1 | 0 | 0 | cols. 5, 6, 11, 16, 17 are 1 |
| | 0 | X | X | 1 | 1 | 0 | 1 | 0 | cols. 6, 7, 11, 15, 16 are 1 |
| | 0 | X | X | 0 | 0 | 0 | 1 | 0 | cols. 7, 8, 11, 14, 15 are 1 |
| | 0 | X | X | 1 | 1 | 0 | 1 | 1 | cols. 8, 9, 11, 13, 14 are 1 |
| | 0 | X | X | 1 | 0 | 1 | 1 | 0 | cols. 9, 10, 11, 12, 13 are 1 |
| | 0 | X | X | 1 | 0 | 1 | 1 | 1 | cols. 3, 17–19 are 1 |
| | 0 | X | X | 1 | 1 | 1 | 0 | 1 | cols. 5, 15–17 are 1 |
| | 0 | X | X | 1 | 1 | 1 | 1 | 1 | cols. 7, 13–15 are 1 |

TABLE 2-continued

| | | | | | | | | Content of Row |
|---|---|---|---|---|---|---|---|---|
| 0 | X | X | 1 | 1 | 1 | 0 | 0 | cols. 11–13 are 1 |
| 0 | X | X | 1 | 1 | 1 | 1 | 0 | cols. 11–15 are 1 |
| 0 | X | X | 1 | 1 | 0 | 0 | 1 | cols. 15–17 are 1 |
| 0 | X | X | 1 | 0 | 0 | 0 | 0 | cols. 17–19 are 1 |
| 0 | X | X | 1 | 0 | 1 | 0 | 1 | cols. 5, 9, 13, 17 are 1 |
| 0 | X | X | 1 | 0 | 1 | 0 | 0 | col. 3 is 1 |
| 0 | X | X | 1 | 0 | 0 | 1 | 0 | col. 5 is 1 |
| 0 | X | X | 0 | 1 | 0 | 1 | 0 | col. 17 is 1 |
| 0 | X | X | 0 | 1 | 0 | 0 | 1 | Col. 19 is 1 |
| SECOND BYTE | | | | | | | | |
| Bit 7 | 6 | 5 | 4 | 3 | 2 | 1 | 0 | |
| 0 | 0 | 0 | 0 | X | X | X | X | second byte used for repeats only |
| 0 | 0 | 0 | 1 | X | X | X | X | cols. 9, 13 are 1 |
| 0 | 0 | 1 | 0 | X | X | X | X | cols. 7, 15 are 1 |
| 0 | 0 | 1 | 1 | X | X | X | X | cols. 7, 11 are 1 |
| 0 | 1 | 0 | 0 | X | X | X | X | cols. 5, 17 are 1 |
| 0 | 1 | 0 | 1 | X | X | X | X | cols. 5, 11 are 1 |
| 0 | 1 | 1 | 0 | X | X | X | X | col. 11 is 1 |
| 0 | 1 | 1 | 1 | X | X | X | X | cols. 11, 15 are 1 |
| 1 | 0 | 0 | 0 | X | X | X | X | cols. 3, 19 are 1 |
| 1 | 0 | 0 | 1 | X | X | X | X | cols. 1, 21 are 1 |
| 1 | 0 | 1 | 0 | X | X | X | X | cols. 11, 19 are 1 |
| 1 | 0 | 1 | 1 | X | X | X | X | cols. 11, 17 are 1 |
| 1 | 1 | 0 | 0 | X | X | X | X | cols. 3, 11 are 1 |
| 1 | 1 | 0 | 1 | X | X | X | X | cols. 5, 11 are 1 |
| 1 | 1 | 1 | 0 | X | X | X | X | cols. 7, 11 are 1 |
| 1 | 1 | 1 | 1 | X | X | X | X | col. 15 is 1 |

Referring first to Table 1, it can be seen by inspection that the first three characters of the first byte in any single row of the representation of a character signifies how many bytes of information are necessary to represent a row in the character representation. For example, if the first bit as seen in Table 1, in reality bit seven in the eight bit byte, or the leftmost bit (bits are normally numbered in descending order from left to right with the low order bit or right bit being the "zero bit"), is a zero (0), the representation in storage of the row is either a "single byte" row or a "double byte" row. If the first bit or the leftmost bit is one (1), it is a three byte row. If bits 6 and 5 are zero (0) in combination with a zero (0) in bit position seven, the row is a "double byte" row. Bits 6 and 5 if not both zero (0) indicate how many times that row is repeated.

In the case of a single byte row, that is a zero (0) in bit position 7 of the first byte, the last five bits (4,3,2,1,0) of the byte give intelligence as to which columns are ones (dots in the output) and which columns are zeros (blanks in the output). The flow charts shown in FIG. 5*a* and 5*b* determine how each row is expanded.

Table 2 indicates the content of the row, for example, if the byte has the pattern 0010111, then that particular row of the finished character would have ones in columns 3–19. It can be seen that this representation, while covering one row, has covered the one row with a "single byte" as opposed to three bytes, as indicated above. Of course, it should be understood that if there are "repeats" of this information, as many as sixteen rows may be repeated in a minimum of two bytes. Tables 3, 4, 5 and 6 represent the bit pattern or "bit maps" of the characters shown in FIGS. 6, 7, 8, and 9, respectively. This scheme will be further explained in the operation of the system. Accordingly, no further information will be set forth here.

TABLE 3

| QU Hexidecimal Representation | Binary Representation | | | | | | | | Remarks | Rows |
|---|---|---|---|---|---|---|---|---|---|---|
| ØØ | 0 | 0 | 0 | 0 | 0 | 0 | 0 | 0 | add second row - no repeats | 1 |
| 6Ø | 0 | 1 | 1 | 0 | 0 | 0 | 0 | 0 | col. 11 is 1 | |
| AØ | 1 | 0 | 1 | 0 | 0 | 0 | 0 | 0 | triple byte - no repeats | 2 |
| ØC | 0 | 0 | 0 | 0 | 1 | 1 | 0 | 0 | | |
| ØØ | 0 | 0 | 0 | 0 | 0 | 0 | 0 | 0 | | |
| AØ | 1 | 0 | 1 | 0 | 0 | 0 | 0 | 0 | triple byte - no repeats | 3 |
| 18 | 0 | 0 | 0 | 1 | 1 | 0 | 0 | 0 | | |
| 4Ø | 0 | 1 | 0 | 0 | 0 | 0 | 0 | 0 | | |
| AØ | 1 | 0 | 1 | 0 | 0 | 0 | 0 | 0 | triple byte - no repeats | 4 |
| 3Ø | 0 | 0 | 1 | 1 | 0 | 0 | 0 | 0 | | |
| 4Ø | 0 | 1 | 0 | 0 | 0 | 0 | 0 | 0 | | |
| 23 | 0 | 0 | 1 | 0 | 0 | 0 | 1 | 1 | one byte C7–15 - no repeats | 5 |
| Ø2 | 0 | 0 | 0 | 0 | 0 | 0 | 1 | 0 | two bytes - 2 repeats | 6–8 |
| 6Ø | 0 | 1 | 1 | 0 | 0 | 0 | 0 | 0 | col. 11 is 1 | |
| 2F | 0 | 0 | 1 | 0 | 1 | 1 | 1 | 1 | no repeats - cols. 3–19 | 9 |
| 2E | 0 | 0 | 1 | 0 | 1 | 1 | 1 | 0 | no repeats - cols. 10–12 | 10 |
| 25 | 0 | 0 | 1 | 0 | 0 | 1 | 0 | 1 | no repeats - cols. 9, 10, 12, 13 | 11 |
| 2B | 0 | 0 | 1 | 0 | 1 | 0 | 1 | 1 | no repeats - cols. 8, 9, 13, 14 | 12 |
| 26 | 0 | 0 | 1 | 0 | 0 | 1 | 1 | 0 | no repeats - cols. 7, 8, 14, 15 | 13 |
| 33 | 0 | 0 | 1 | 1 | 0 | 0 | 1 | 1 | no repeats - cols. 6, 7, 15, 16 | 14 |
| A1 | 1 | 0 | 1 | 0 | 0 | 0 | 0 | 1 | triple byte - no repeats | 15 |
| 9F | 1 | 0 | 0 | 1 | 1 | 1 | 1 | 1 | | |

TABLE 3-continued

| QU Hexidecimal Representation | Binary Representation | | | | | | | | Remarks | Rows |
|---|---|---|---|---|---|---|---|---|---|---|
| 30 | 0 | 0 | 1 | 1 | 0 | 0 | 0 | 0 | | |
| 2D | 0 | 0 | 1 | 0 | 1 | 1 | 0 | 1 | no repeats - cols. 4, 5, 17, 18 | 16 |
| A6 | 1 | 0 | 1 | 0 | 0 | 1 | 1 | 0 | triple byte - no repeats | 17 |
| 1F | 0 | 0 | 0 | 1 | 1 | 1 | 1 | 1 | | |
| ØC | 0 | 0 | 0 | 0 | 1 | 1 | 0 | 0 | | |
| 2Ø | 0 | 0 | 1 | 0 | 0 | 0 | 0 | 0 | zeros | 18 |
| 23 | 0 | 0 | 1 | 0 | 0 | 0 | 1 | 1 | C7–15 | 19 |
| 40 | 0 | 1 | 0 | 0 | 0 | 0 | 0 | 0 | zeros - one repeat | 20–21 |

TABLE 4

| @M Hexidecimal Representation | Binary Representation | | | | | | | | Remarks | Rows |
|---|---|---|---|---|---|---|---|---|---|---|
| 03 | 0 | 0 | 0 | 0 | 0 | 0 | 1 | 1 | cols. 7–15 | 1 |
| 0E | 0 | 0 | 0 | 0 | 1 | 1 | 1 | 0 | exception | |
| 01 | 0 | 0 | 0 | 0 | 0 | 0 | 0 | 1 | 1 repeat - cols. 7, 15 | 2–3 |
| 20 | 0 | 0 | 1 | 0 | 0 | 0 | 0 | 0 | | |
| 23 | 0 | 0 | 1 | 0 | 0 | 0 | 1 | 1 | cols. 7–15 - no repeats | 4 |
| C2 | 1 | 1 | 0 | 0 | 0 | 0 | 1 | 0 | triple byte - 1 repeat | 5–6 |
| 40 | 0 | 1 | 0 | 0 | 0 | 0 | 0 | 0 | | |
| 48 | 0 | 1 | 0 | 0 | 1 | 0 | 0 | 0 | | |
| A2 | 1 | 0 | 1 | 0 | 0 | 0 | 1 | 0 | triple byte - no repeats | 7 |
| 7F | 0 | 1 | 1 | 1 | 1 | 1 | 1 | 1 | | |
| C8 | 1 | 1 | 0 | 0 | 1 | 0 | 0 | 0 | | |
| C2 | 1 | 1 | 0 | 0 | 0 | 0 | 1 | 0 | triple byte - 1 repeat | 8–9 |
| 40 | 0 | 1 | 0 | 0 | 0 | 0 | 0 | 0 | | |
| 48 | 0 | 1 | 0 | 0 | 1 | 0 | 0 | 0 | | |
| A2 | 1 | 0 | 1 | 0 | 0 | 0 | 1 | 0 | triple byte - no repeats | 10 |
| 7F | 0 | 1 | 1 | 1 | 1 | 1 | 1 | 1 | | |
| C8 | 1 | 1 | 0 | 0 | 1 | 0 | 0 | 0 | | |
| C2 | 1 | 1 | 0 | 0 | 0 | 0 | 1 | 0 | triple byte - 1 repeat | 11–12 |
| 00 | 0 | 0 | 0 | 0 | 0 | 0 | 0 | 0 | | |
| 08 | 0 | 0 | 0 | 0 | 1 | 0 | 0 | 0 | | |
| A3 | 1 | 0 | 1 | 0 | 0 | 0 | 1 | 1 | triple byte - no repeats | 13 |
| F1 | 1 | 1 | 1 | 1 | 0 | 0 | 0 | 1 | | |
| F8 | 1 | 1 | 1 | 1 | 1 | 0 | 0 | 0 | | |
| 02 | 0 | 0 | 0 | 0 | 0 | 0 | 1 | 0 | 2 repeats - cols. 9, 13 | 14–16 |
| 10 | 0 | 0 | 0 | 1 | 0 | 0 | 0 | 0 | | |
| A3 | 1 | 0 | 1 | 0 | 0 | 0 | 1 | 1 | triple byte - no repeats | 17 |
| F1 | 1 | 1 | 1 | 1 | 0 | 0 | 0 | 1 | | |
| F8 | 1 | 1 | 1 | 1 | 1 | 0 | 0 | 0 | | |
| 82 | 1 | 0 | 0 | 0 | 0 | 0 | 1 | 0 | triple byte with 3 repeats | 18–21 |
| 11 | 0 | 0 | 0 | 1 | 0 | 0 | 0 | 1 | | |
| 08 | 0 | 0 | 0 | 0 | 1 | 0 | 0 | 0 | | |

TABLE 5

| MH Hexidecimal Representation | Binary Representation | | | | | | | | Remarks | Rows |
|---|---|---|---|---|---|---|---|---|---|---|
| BF | 1 | 0 | 1 | 1 | 1 | 1 | 1 | 1 | triple byte - no repeats | 1 |
| F1 | 1 | 1 | 1 | 1 | 0 | 0 | 0 | 1 | | |
| FF | 1 | 1 | 1 | 1 | 1 | 1 | 1 | 1 | | |
| D0 | 1 | 1 | 0 | 1 | 0 | 0 | 0 | 0 | triple byte - 1 repeat | 2–3 |
| 11 | 0 | 0 | 0 | 1 | 0 | 0 | 0 | 1 | | |
| 01 | 0 | 0 | 0 | 0 | 0 | 0 | 0 | 1 | | |
| BF | 1 | 0 | 1 | 1 | 1 | 1 | 1 | 1 | triple byte - no repeats | 4 |
| F1 | 1 | 1 | 1 | 1 | 0 | 0 | 0 | 1 | | |

TABLE 5-continued

| MH Hexidecimal Representation | Binary Representation | | | | | | | | Remarks | Rows |
|---|---|---|---|---|---|---|---|---|---|---|
| FF | 1 | 1 | 1 | 1 | 1 | 1 | 1 | 1 | | |
| D0 | 1 | 1 | 0 | 1 | 0 | 0 | 0 | 0 | triple byte - 1 repeat | 5–6 |
| 11 | 0 | 0 | 0 | 1 | 0 | 0 | 0 | 1 | | |
| 01 | 0 | 0 | 0 | 0 | 0 | 0 | 0 | 1 | | |
| BF | 1 | 0 | 1 | 1 | 1 | 1 | 1 | 1 | triple byte - no repeats | 7 |
| F1 | 1 | 1 | 1 | 1 | 0 | 0 | 0 | 1 | | |
| FF | 1 | 1 | 1 | 1 | 1 | 1 | 1 | 1 | | |
| D0 | 1 | 1 | 0 | 1 | 0 | 0 | 0 | 0 | triple byte - 1 repeat | 8–9 |
| 11 | 0 | 0 | 0 | 1 | 0 | 0 | 0 | 1 | | |
| 01 | 0 | 0 | 0 | 0 | 0 | 0 | 0 | 1 | | |
| BF | 1 | 0 | 1 | 1 | 1 | 1 | 1 | 1 | triple byte - no repeats | 10 |
| F1 | 1 | 1 | 1 | 1 | 0 | 0 | 0 | 1 | | |
| FF | 1 | 1 | 1 | 1 | 1 | 1 | 1 | 1 | | |
| AC | 1 | 0 | 1 | 0 | 1 | 1 | 0 | 0 | triple byte - no repeats | 11 |
| 64 | 0 | 1 | 1 | 0 | 0 | 1 | 0 | 0 | | |
| C6 | 1 | 1 | 0 | 0 | 0 | 1 | 1 | 0 | | |
| B8 | 1 | 0 | 1 | 1 | 1 | 0 | 0 | 0 | triple byte - 1 repeat | 12 |
| 35 | 0 | 0 | 1 | 1 | 0 | 1 | 0 | 1 | | |
| 83 | 1 | 0 | 0 | 0 | 0 | 0 | 1 | 1 | | |
| A0 | 1 | 0 | 1 | 0 | 0 | 0 | 0 | 0 | triple byte - no repeats | 13 |
| 0C | 0 | 0 | 0 | 0 | 1 | 1 | 0 | 0 | | |
| 00 | 0 | 0 | 0 | 0 | 0 | 0 | 0 | 0 | | |
| A0 | 1 | 0 | 1 | 0 | 0 | 0 | 0 | 0 | triple byte - no repeats | 14 |
| 18 | 0 | 0 | 0 | 1 | 1 | 0 | 0 | 0 | | |
| 00 | 0 | 0 | 0 | 0 | 0 | 0 | 0 | 0 | | |
| 2F | 0 | 0 | 1 | 0 | 1 | 1 | 1 | 1 | one byte - no repeats - cols. 3–19 | 15 |
| 2B | 0 | 0 | 1 | 0 | 1 | 0 | 1 | 1 | one byte - no repeats - cols. 8–9, | 16 13–14 |
| 25 | 0 | 0 | 1 | 0 | 0 | 1 | 0 | 1 | one byte - no repeats - cols. 9–10, 12–13 | 17 |
| 4E | 0 | 1 | 0 | 0 | 1 | 1 | 1 | 0 | one byte - 1 repeat cols. 10–12 | 18–19 |
| 25 | 0 | 0 | 1 | 0 | 0 | 1 | 0 | 1 | one byte - no repeats - cols. 9–10, 12–13 | 20 |
| 2B | 0 | 0 | 1 | 0 | 1 | 0 | 1 | 1 | cols. 8–9, 13–14 | 21 |

TABLE 6

| WY Hexidecimal Representation | Binary Representation | | | | | | | | Remarks | Rows |
|---|---|---|---|---|---|---|---|---|---|---|
| 00 | 0 | 0 | 0 | 0 | 0 | 0 | 0 | 0 | | 1–4 |
| 0F | 0 | 0 | 0 | 0 | 1 | 1 | 1 | 1 | all blanks repeats 3 repeats | |
| 27 | 0 | 0 | 1 | 0 | 0 | 1 | 1 | 1 | single - no repeats cols. 5–17 | 5 |
| 1F | 0 | 0 | 0 | 1 | 1 | 1 | 1 | 1 | single | 6–10 |
| 61 | 0 | 1 | 1 | 0 | 0 | 0 | 0 | 1 | col. 11 - 4 repeats | |
| 27 | 0 | 0 | 1 | 0 | 0 | 1 | 1 | 1 | single - no repeats cols. 5–17 | 11 |
| 1F | 0 | 0 | 0 | 1 | 1 | 1 | 1 | 1 | single - 4 repeats col. 11 | 12–16 |
| 61 | 0 | 1 | 1 | 0 | 0 | 0 | 0 | 1 | | |
| 2F | 0 | 0 | 1 | 0 | 1 | 1 | 1 | 1 | single - no repeats cols. 3–19 | 17 |
| 00 | 0 | 0 | 0 | 0 | 0 | 0 | 0 | 0 | single - all blanks 3 repeats | 18–21 |
| 0F | 0 | 0 | 0 | 0 | 1 | 1 | 1 | 1 | | |

Figure 4A:
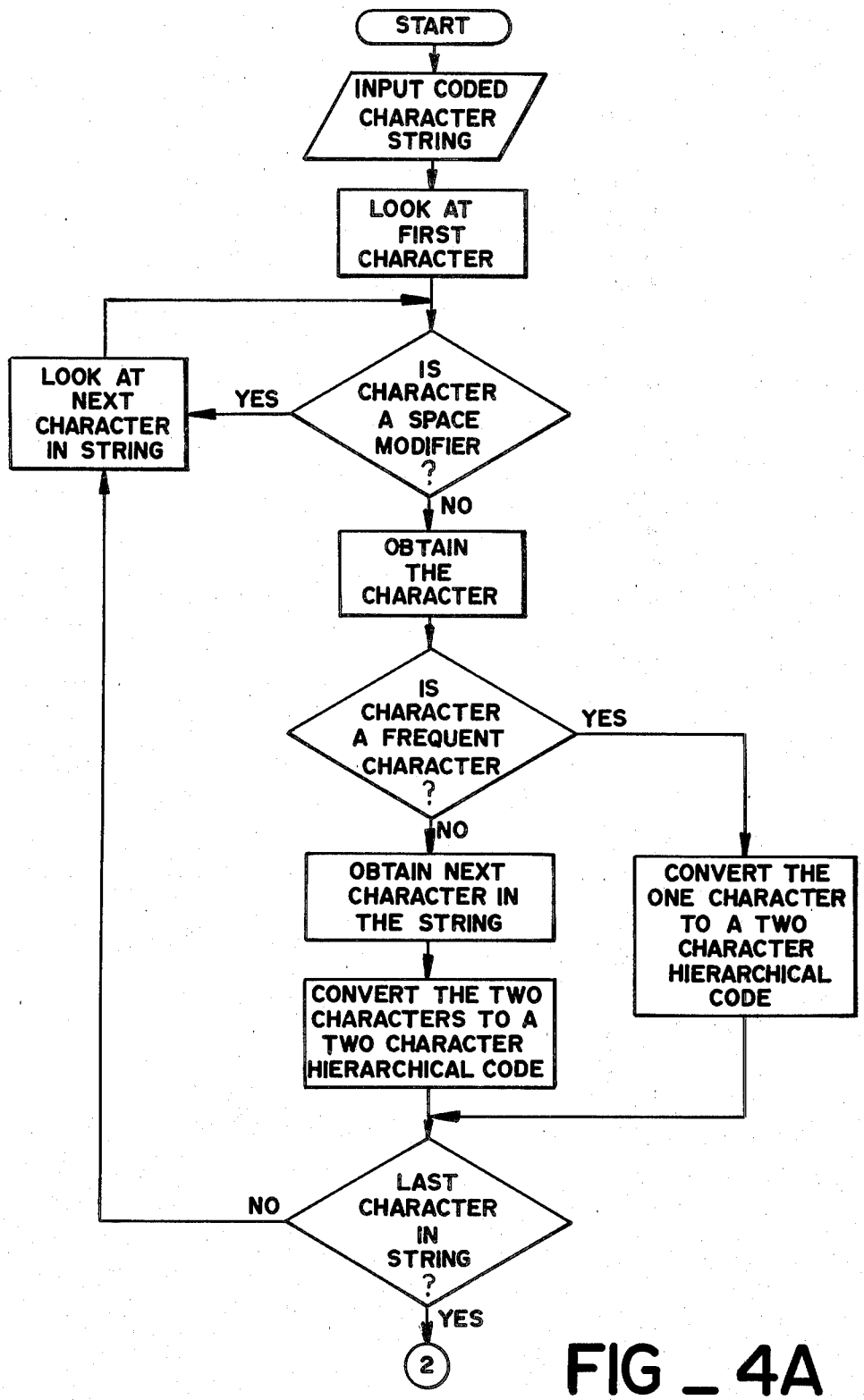
FIG. 4*a* and 4*b* is a flow chart of the system as used in the computer system depicted in FIG. 1.

Certain characters in any ideographic language may be repeated with a greater frequency than other characters. Accordingly, it may be appropriate to reserve certain single characters for such use. Should this be done, the single character can easily be transliterated into a double character, since these frequent characters generally would also occur on the matrix appearing in Appendix 1. FIG. 4a, which is the flow chart representative of this system, indicates that there may be a single character type code. Should this occur, then one branches to the conversion routine to convert the single character to two-character hierarchical code representative of a character in Appendix 1. It should be remembered that this hierarchical code is the code to which the two-character input code is converted upon entry of the code represented in the matrix in Appendix 1 into the computer.

Figure 11:
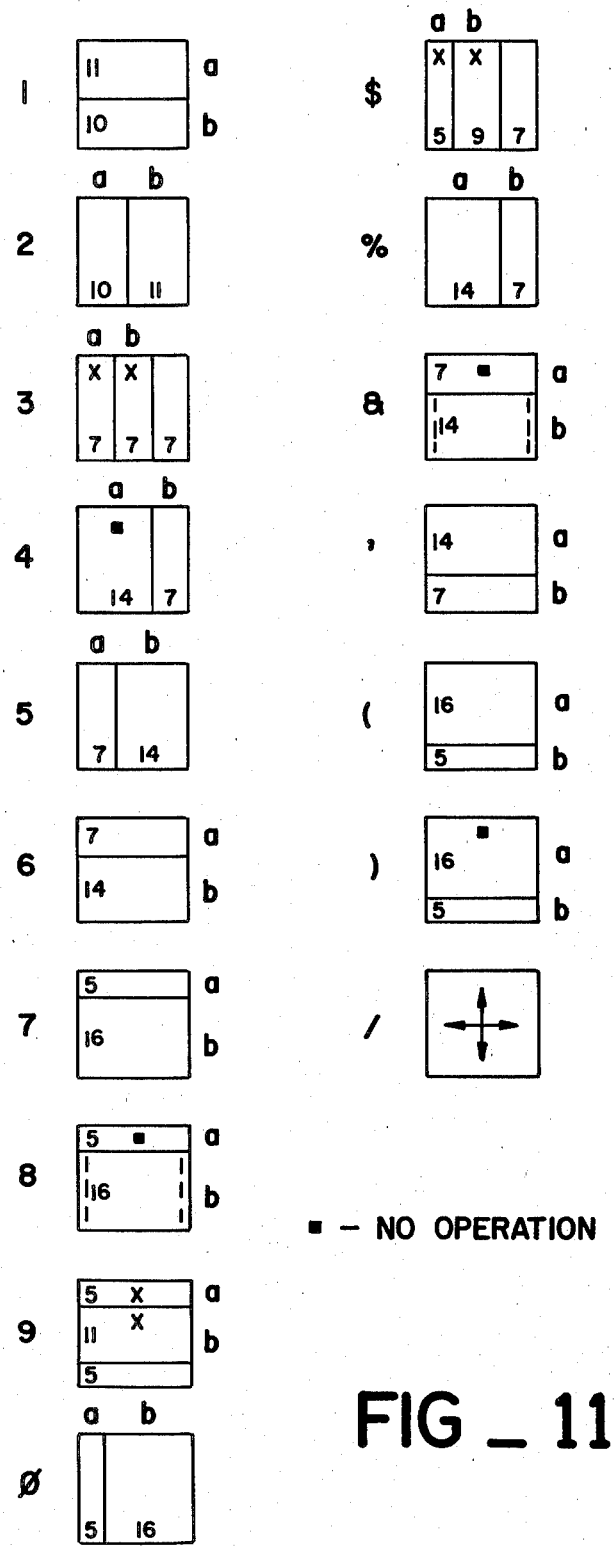
FIG. 11 is representative of the various means of combining characters utilizing this system.

As was mentioned earlier, certain characters in ideographic character sets may be formed of two or more ideograms. Accordingly, this invention provides for such a combination. More importantly, the present system combines the characters such that the outputted character remains essentially the same size as one of the two inputted characters. Specifically, each of the inputted characters, as previously noted, is represented by a twenty-one by twenty-one dot matrix. This invention compresses each of the inputted characters so that the combined character is represented on output means 24 by a twenty-one by twenty-one dot matrix. Reference should be made to FIG. 11 wherein the various shape operators are shown. Specifically, the shape operator 1 will take the first character, represented in FIG. 11 adjacent shape operator by small letter "a", and reduce it in one dimension, specifically by withdrawing certain rows so that the resulting compressed character is eleven rows by twenty-one columns. The second character, represented by a lower case "b" in FIG. 11, is reduced to ten rows by twenty-one columns. While not considered limiting, the characters in Appendix 1 have been formed so that generally during row removal such as just described, the even numbered rows are removed leaving odd numbered rows. Specifically, in the row operation indicated by the numeral 1 in FIG. 11, rows 1, 3, 5, 7, 9, 11, 13, 15, 17, 19, and 21 remain after the operation on the upper or "a" element in FIG. 11. As to the operation on element "b," it has been found that the same rows will remain, except that row 1 will also be eliminated, thus leaving ten rows for the resulting character. Tables 7a and 7b which follow indicate the columns or rows remaining after each shape operation:

TABLE 7a

| Column | 1 | 2 | 3 | 4 | 5 | 6 | 7 | 8 | 9 | 10 | 11 | 12 | 13 | 14 | 15 | 16 | 17 | 18 | 19 | 20 | 21 |
|---|---|---|---|---|---|---|---|---|---|---|---|---|---|---|---|---|---|---|---|---|---|
| Shape 1 Øb (16 right) | | | | | | | 3 | | | 7 | 8 | 9 | | | | | | | | | |
| Shape 2 §a Øa (5 left) | 5 | 9 | 11 | 13 | 17 | | | | | | | | | | | | | | | | |
| Shape 3 3a 5a (7 left) | 5 | 7 | 9 | 11 | 13 | 15 | 17 | | | | | | | | | | | | | | |
| Shape 4 5b (14 right) | | | | | | | | 1 | 3 | 5 | 6 | 7 | 9 | 10 | 11 | 12 | 13 | 15 | 17 | 19 | 21 |
| Shape 5 %a (14 left) | 1 | 3 | 5 | 6 | 7 | 9 | 10 | 11 | 12 | 13 | 15 | 17 | 19 | 21 | | | | | | | |
| Shape 6 §b (9 middle) | | | | | | 3 | 5 | 7 | 9 | 11 | 13 | 15 | 17 | 19 | | | | | | | |
| Shape 7 4b %b (7 right) | | | | | | | | | | | | | | | 5 | 7 | 9 | 11 | 13 | 15 | 17 |
| Shape 8 3b (7 middle) | | | | | | | | 5 | 7 | 9 | 11 | 13 | 15 | 17 | | | | | | | |
| Shape 9 2a (10 left) | 1 | 3 | 5 | 7 | 9 | 11 | 13 | 15 | 17 | 19 | | | | | | | | | | | |
| Shape 10 2b | | | | | | | | | | | 1 | 3 | 5 | 7 | 9 | 11 | 13 | 15 | 17 | 19 | 21 |

TABLE 7b

| | | | |
|---|---|---|---|
| Shape 11 | 1 | Shape 12 | 5 |
| 7b | 3 | (b | 9 |
| 8b | 4 | 7a | 11 |
| )b | 5 | (5 rows) | 13 |
| (a | 7 | | 17 |
| (16 rows) | 8 | | |
| | 9 | | |
| | 10 | Shape 13 | 1 |
| | 11 | &b | 3 |
| | 13 | 6b | 5 |
| | 14 | 'a | 6 |
| | 15 | (14 rows) | 7 |
| | 17 | | 9 |
| | 18 | | 10 |
| | 19 | | 11 |
| | 21 | | 13 |
| | | | 15 |
| | | | 17 |
| | | | 19 |
| | | | 21 |
| Shape 14 | 5 | Shape 16 | 3 |
| 6a | 7 | 1b | 5 |
| 'b | 9 | (10 rows) | 7 |
| (7 rows) | 11 | | 9 |
| | 13 | | 11 |
| | 15 | | 13 |
| | 17 | | 15 |
| | | | 17 |
| Shape 15 | 1 | | 19 |
| 9b | 3 | | 21 |
| 1a | 5 | | |
| (11 rows) | 7 | | |
| | 9 | | |
| | 11 | | |
| | 13 | | |
| | 15 | | |
| | 17 | | |

TABLE 7b-continued

| |
|---|
| 19 |
| 21 |

In Tables 7a and 7b, each of the resulting shapes are numbered from 1 to 16. Associated with each resulting shape are the appropriate shape operators shown in FIG. 11 along with whether the resulting shape is the "a" or "b" portion of the operator. For example, shape operator 5 results in resulting shape 3 for the left hand or "a" character and resulting shape 4 for the right hand or "b" character. When shape operator 1 is called for, as in the example above, the upper or "a" portion takes the resulting shape 15 while the lower or "b" character takes on shape 16. It should be noted that certain shape operators shown in FIG. 11 permit the character to remain as it was originally or to reposition the character only. These are represented in FIG. 11 by the "no operation" phrase, or by arrows.

Reference to FIG. 11 indicates that two characters could be juxtaposed, one above another, or one adjacent the second as shown in the first two space operations. Further, should one desire a character composed of three characters such as indicated by shape operator 3 of FIG. 11, the two characters "a" and "b" are first compressed to seven columns and with each leaving seven empty columns, as indicated in FIG. 3. Then shape operation 4 of FIG. 11 may be utilized, wherein the "a" is comprised of the two characters made in operation 3, while the "b" is a totally new character that is compressed horizontally to seven columns. The operations depicted in numeral 8 and the ampersand operation as shown in FIG. 11 are to be used with characters that have some sort of side elements that are relatively narrow. For example, reference is made to the character "C*" in Appendix 1. This character could be combined with a relatively narrow character such as "QP." Of course, it is understood that the operator of the machine would be proficient in the selection of the various components of the finished ideogram. The components referenced heretofore are for illustration purposes only and may not necessarily form a valid Oriental character.

The shape operations in this system are performed by inputting the desired shape operations followed by the desired characters. Thus, should one desire to combine the shape of character "MH" with the shape of the character "WY" with the character "MH" to the right, the command entered at the keyboard would be "5WYMH."

Figure 8:
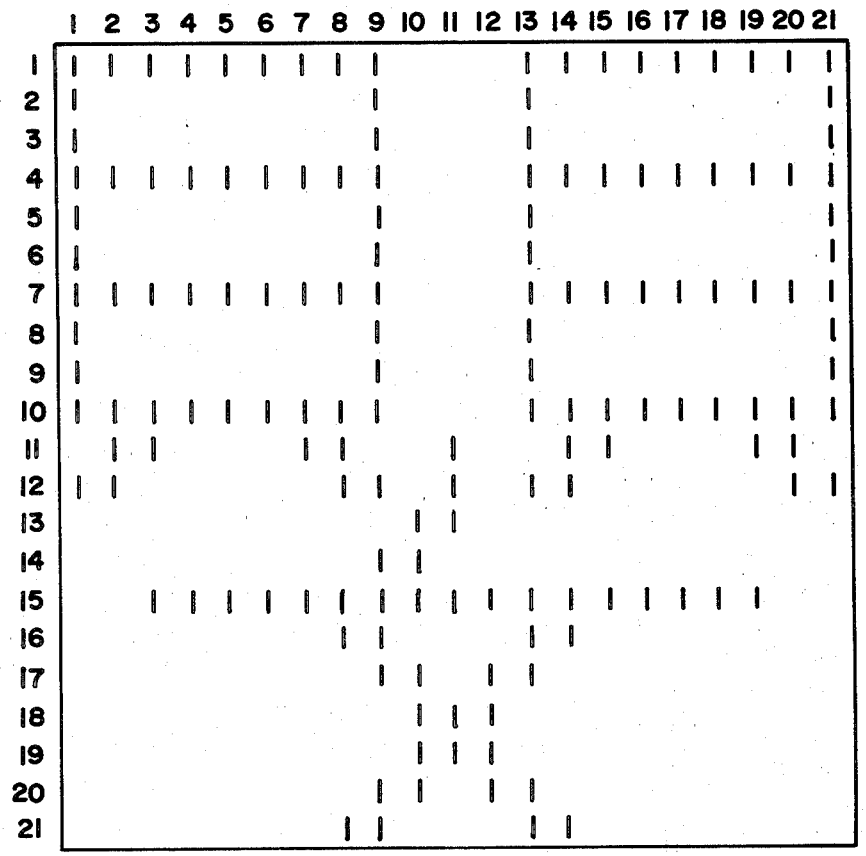
FIG. 8 is still another ideogram as outputted on a dot matrix.
Figure 9:
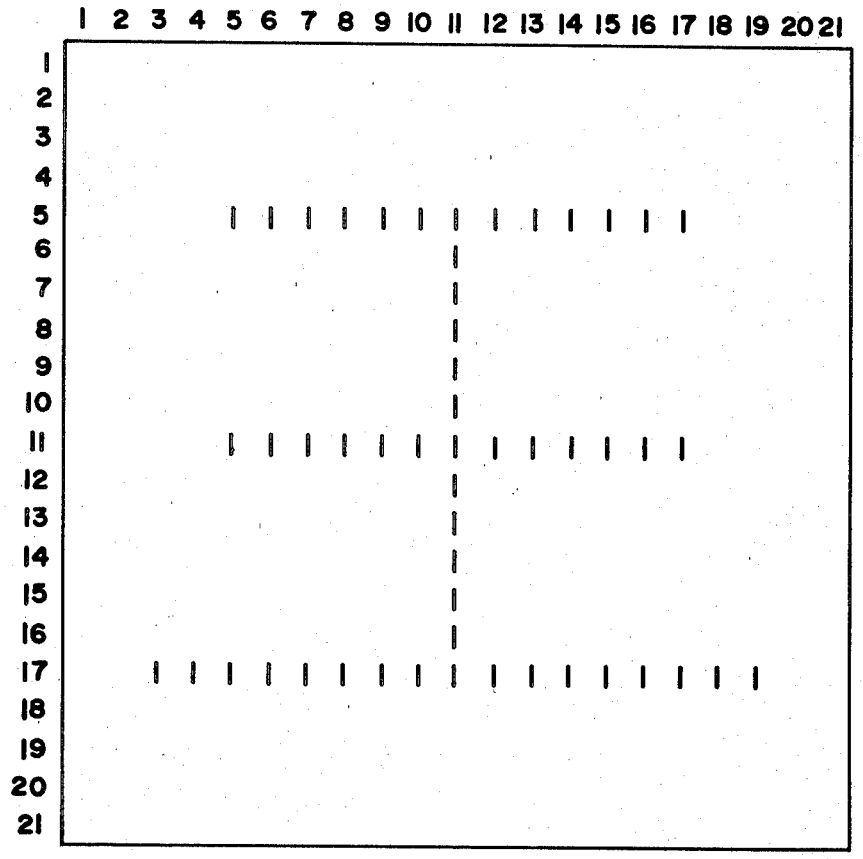
FIG. 9 is still another ideogram as outputted on a dot matrix.
Figure 10:
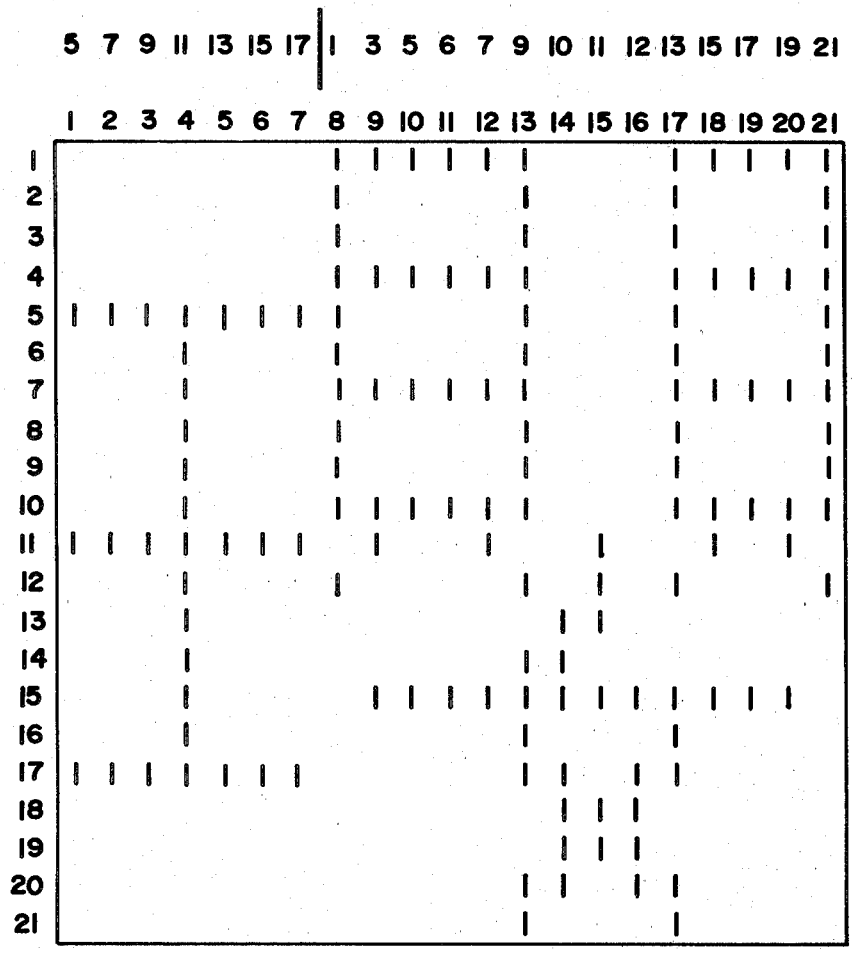
FIG. 10 is a combination of the ideograms shown in FIGS. 8 and 9 as reduced by the system described herein.

Reference is made to FIG. 8 wherein the bit structure of the character "MH" is shown. For information's sake, the character depicted by the "MH" character is the Chinese character for "child" while the character "WY," which is shown in FIG. 9, represents "gem." The combination of these two characters, "child" and "gem" makes the character for "jewelry." This combined character is shown in FIG. 10. The internal bit representation of the characters for "child" and "gem" are represented by the alphabetic characters "MH" and the "WY" shown in Tables 5 and 6, respectively. These particular byte patterns have been "deciphered" in the "Remarks" column so that the reader will recognize the particular pattern. It should be noted that those characters denoted "triple byte" are the actual representation of the character as stored in processor 20 or storage 22. Of course, it should be understood that the first three bits of at least certain bytes, that is, in bit position 7, 6, and 5, is the code to indicate the composition of the byte as indicated above.

Figure 7:
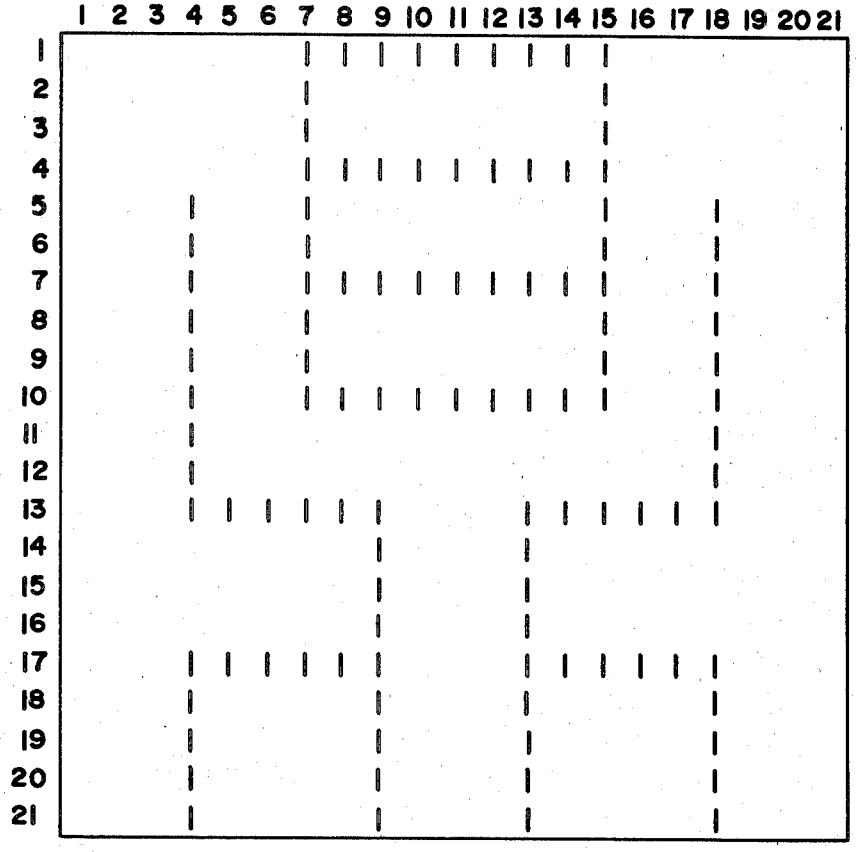
FIG. 7 is another ideogram as outputted on a dot matrix.

It should be apparent to those skilled in the art that certain characters are not amenable to "compression" as described above. An example of this type of character is represented by the Chinese ideogram meaning "urn" which is represented in Appendix 1 by the character associated with the ASCII letters "@M." This character is shown in FIG. 7. The bit representation as it occurs in storage 22 is shown in Table 4 above. An "exception" flag is placed in the second byte of the character as it is represented in storage 22 of the computer system 10. Referring to Table 1, it will be seen that the second byte in the case of a rule exception contains the bit pattern 1110 in bits 3, 2, 1, and 0, respectively. For those skilled in the art, this is representative of the hexidecimal "E. " This representation is apparent in Table 5, wherein the hexidecimal representation of the second byte is "OE." The exception flag indicates that that row is not to be removed. The system will, instead, remove the next row that does not have an exception flag associated with it, in this instance row 2.

Applicability

Referring now to FIG. 1, the system envisioned is depicted as being a part of and in combination with a general purpose computer system 10, the system being resident in the processor 20 and operable in response to coded character strings entered by means of an input device such as keyboard 18. Referring now to FIG. 4*a*, a coded character string is inputted at the start through keyboard 18. The processor 20 in response to the input of the coded character string looks at the first character entered therein to determine if the first character is a space modifier or space operator as defined in FIG. 11 and Tables 7*a* and 7*b*. If the character is a space modifier, the system will look at the next character in the string and continue looking at the next succeeding character until a non-space modifier or operator is obtained. For convenience, a non-space operator will be referred to as a root character. Once a root character is obtained, the root character will be set aside or looked at to determine if the character is a "frequent" character if this provision is included in the invention. It should be remembered that this option is available in the system so that characters occurring rather frequently may be generated by a single key stroke rather than two key strokes. If the character is a "frequent" character, the character may be converted immediately to a two-character hierarchical code shown in FIG. 3.

Should the character not be a "frequent" character, the next character in the character string is obtained and the two characters then resident in the processor are converted to the two character hierarchical code as shown in FIG. 3.

The following step consists of checking to see if the last character in the string has been obtained. If not, then a system will look at the next character in the string and proceed through the steps as set forth above until the last character in the string is obtained. The conversion process from the input code or, in the instance discussed herein, from an ASCII character code, to the conversion as indicated in FIG. 2, results in the hierarchical sorting of the ideogram which will ultimately be depicted on the output device 26 or 28. Thus, an ideogram depicted on output device 26 or 28 having a horizontal line in the lower righthand corner will precede ideograms having a vertical line in the lower righthand corner. Similarly, an ideogram having a vertical line in the lower righthand corner will precede the downwardly sloping line to the left in the lower righthand corner, which in turn will precede the downwardly sloping line to the right. The last formative of the ideogram in the hierachy will be that having a short dash or a dot in the lower righthand corner. Reference to Appendix 1 will make this hierarchy apparent, particularly to those skilled in the art.

Once the character string is obtained in its entirely and the characters converted to the hierarchical codes as described, the syntax of the incoming string is checked. Valid syntax patterns are shown in Table 8:

TABLE 8

| Valid Syntax | Capital Letter - Two character root code | Number - Shape operator |
|---|---|---|
| 1 | A | A |
| 2 | 1AB | 1AB |
| 3 | 21ABC | 2(1AB)C |
| 4 | 2A1BC | 2A(1BC) |
| 5 | 321ABCD | 3(2(1AB)C)D |
| 6 | 3A2B1CD | 3A(2B(1CD)) |
| 7 | 32AB1CD | 3((2AB)(1CD)) |
| 8 | 3A21BCD | 3A(2(1BC)D) |
| 9 | 32A1BCD | 3(2A(1BC))D |

Table 8 utilizes the single capital letter to indicate a two-character root code and a numeral to indicate a shape operator. Thus, if a two-character root code constitutes the inputted character string as converted to the hierarchical code, there is no shape operation to be performed. Should there be a single numeral followed by two two-character root strings as indicated in line 2 of Table 8, then the two two-character root codes are combined in accord with the shape operator that is indicated by the numeral. Where there are several shape operations to be performed, the operations are ordered as indicated by the parenthesis. Thus, in the ninth valid syntax, "B" and "C" are combined with the resulting character combined with "A." That resulting character is then combined with "D." These shape operators are shown in FIG. 11. Specifically, if shape operator 1 is to be performed, the first two-character root code signified by the letter "a" in FIG. 11 is placed above the second root code signified by the letter "b." Specifically, eleven rows of the two-character root code "a" are moved upwardly while ten rows of root code "b" are moved downwardly. The particular rows selected are indicated in Table 7a which lists the various shape operators. Particularly, shape 15 is utilized for the route code "a" and shape 16 is utilized for the route code "b."

Figure 15:
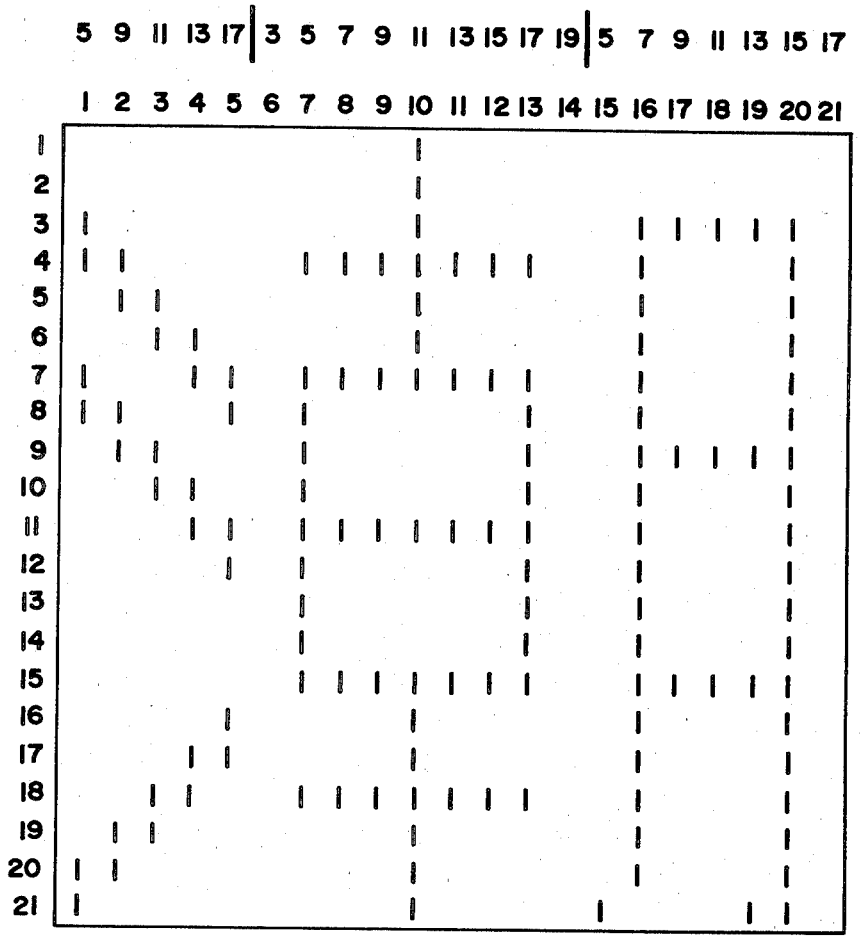
FIG. 15 is a combination of the ideograms shown in FIGS. 12–14 as reduced by the system described herein.

Exampoles of combined characters are given in FIGS. 10 and 15. FIG. 10, as previously noted, is composed of the two characters shown in FIGS. 8 and 9 with the shape operator 5 applied thereto. Shape operator 5 referring to Table 8 utilizes shape 4 for the compression of the character shown in FIG. 8 and utilizes shape 3 for the character shown in FIG. 9. The combined character, as previously noted, is shown in FIG. 10 with the columns from each of the original characters shown above the twenty-one columns of the ensuing matrix.

Figure 5A:
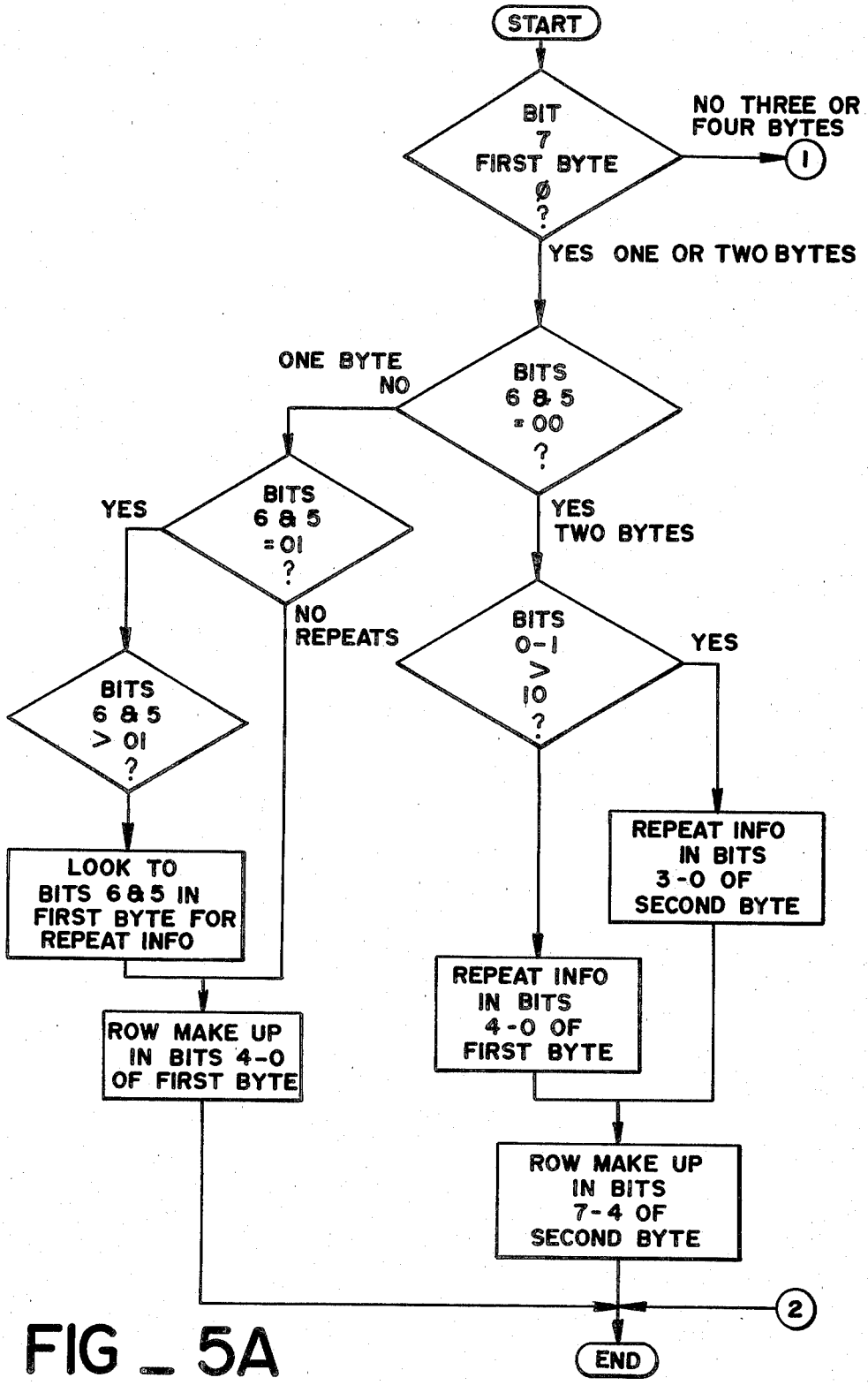
FIGS. 5*a* and 5*b* are flow charts of the system utilized to expand the internal representation of the ideograms.
Figure 5B:
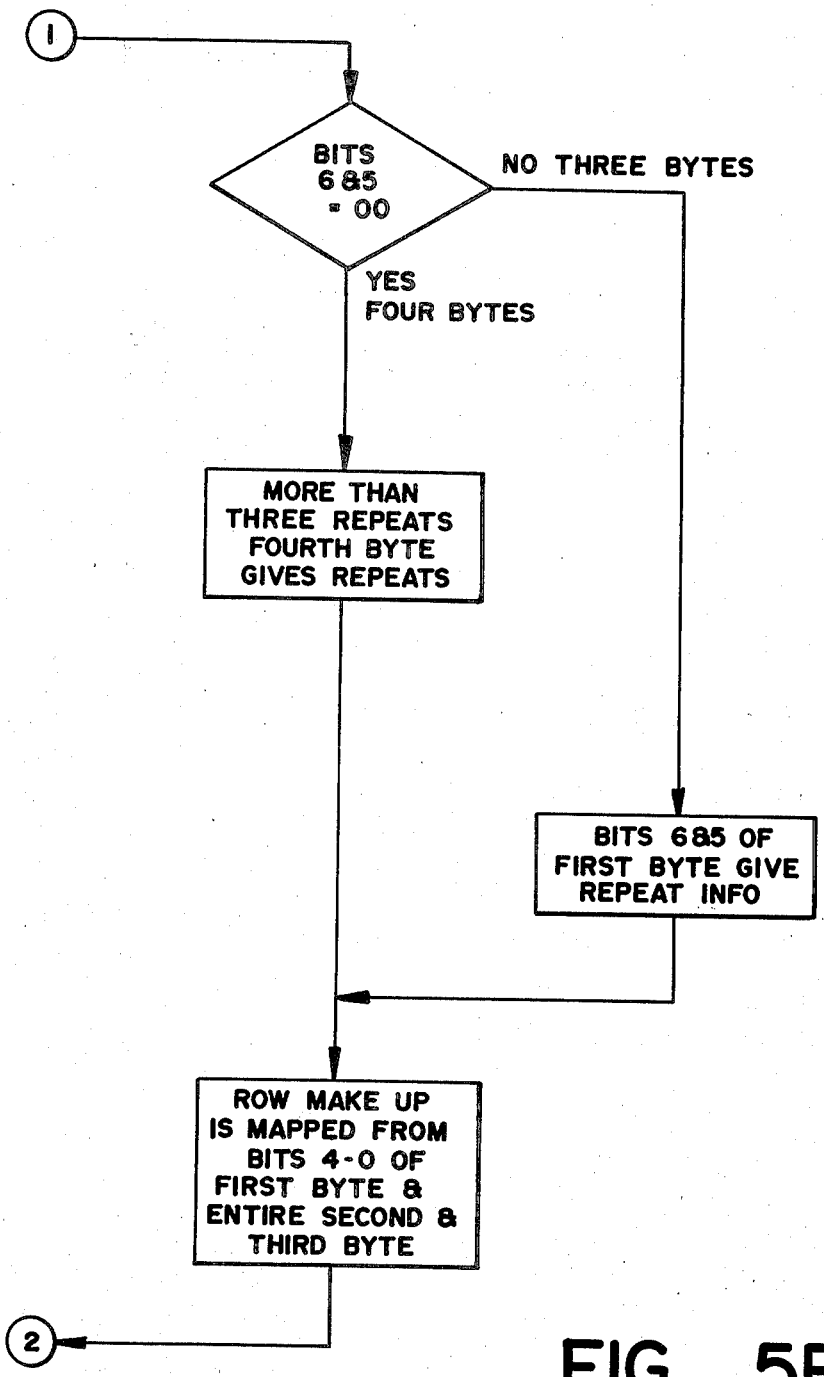
Figure 6:
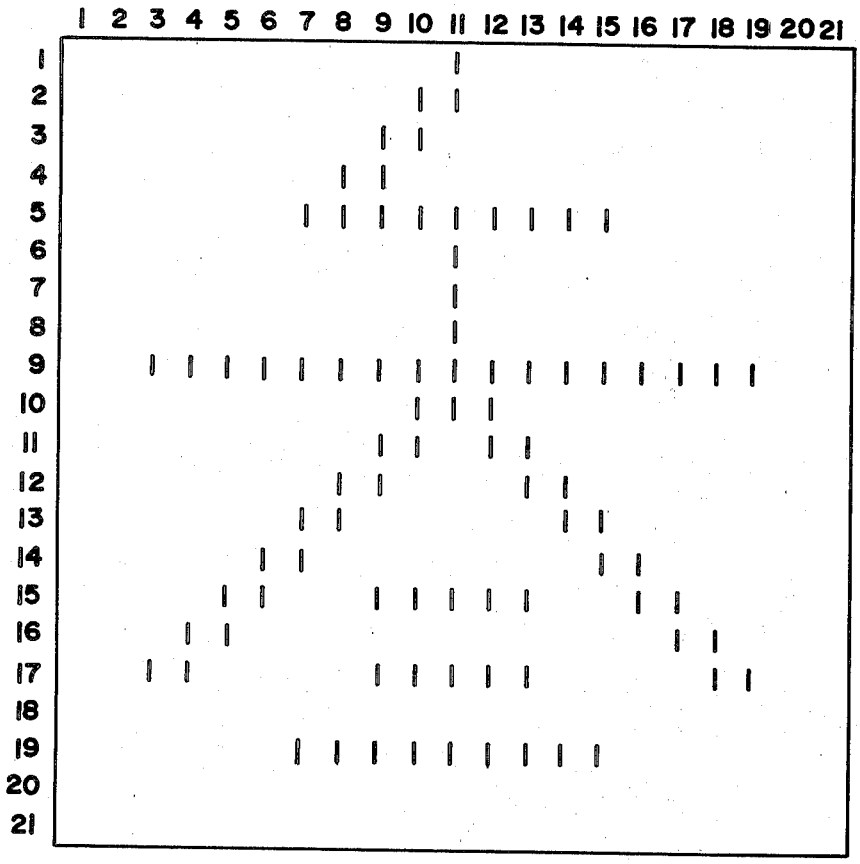
FIG. 6 is a representative ideogram as outputted on a dot matrix.

Before performing shape modifications, the bit map associated with the two-character hierarchical code is developed for the stored information. For example, the information contained in Tables 3, 4, 5, and 6 is expanded to a twenty-one by twenty-one matrix using the rules set forth in Tables 1 and 2. The flow of this logic is illustrated in FIGS. 5*a* and 5*b*. It should be understood that the flow diagram shown in FIGS. 5*a* and 5*b* is applicable to the expansion of one group of bytes. The number of bytes in one single group necessary to construct one or more rows is contained in the first three bits of the first byte associated with that row group. In certain instances, additional information is contained in following bits, but in all cases the first three bits of the first byte will establish the group length as shown in FIGS. 5*a* and 5*b* and Tables 1 and 2.

Figure 4B:
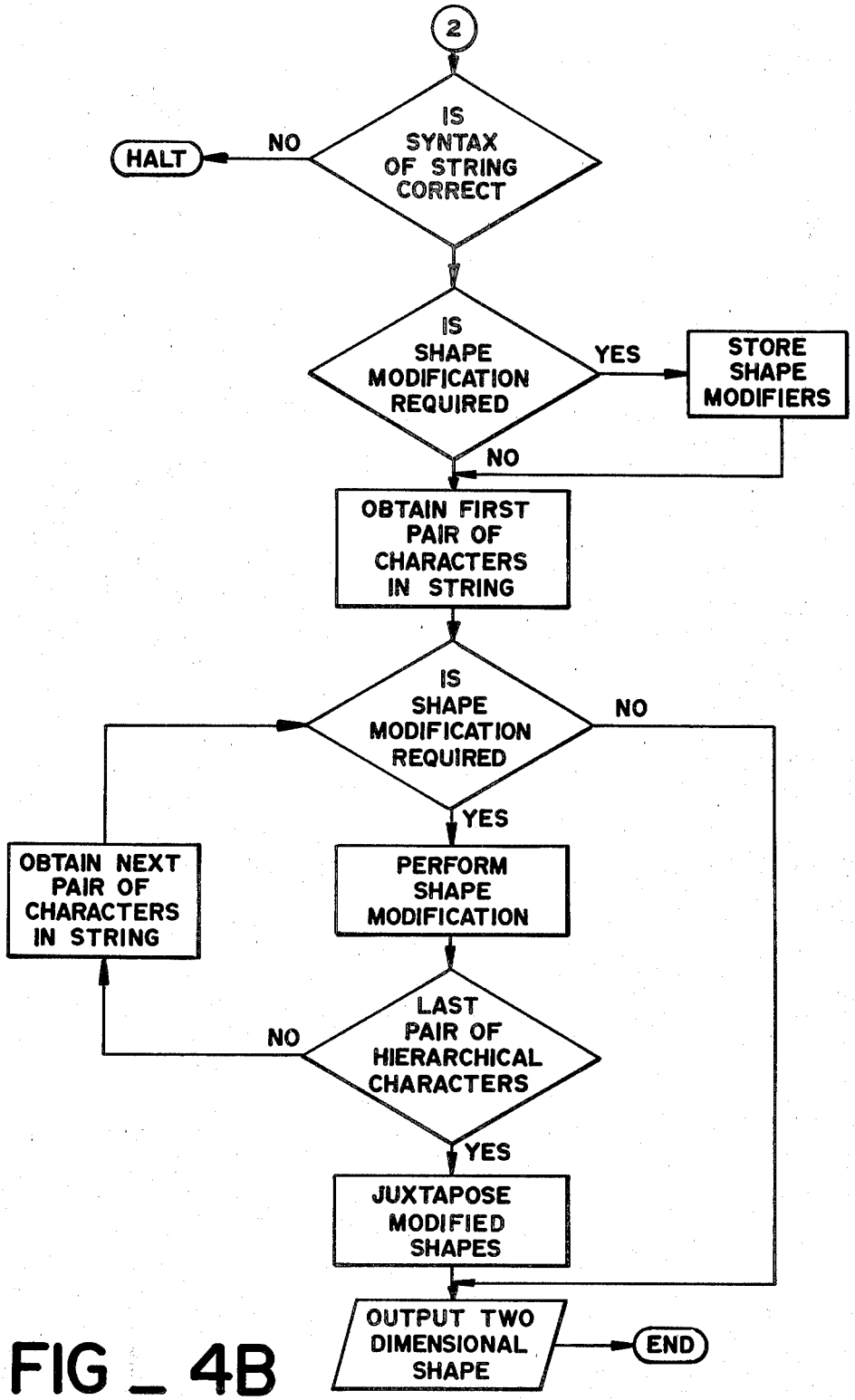

The steps of shape modification are indicated in FIG. 4*b* wherein the basic logic of the operations within the computer is set forth in a flow chart-type diagram. Specifically, the character string is checked to see if a shape modification is required. If it is not required, then the first pair of the hierarchical string is obtained and the outputted two-dimensional shape is developed from the internally stored bit map and displayed on the output device. If shape modification is required, the first pair of the hierarchical string is obtained, and the twenty-one by twenty-one matrix is developed as set forth above, and then shape modification is performed on the developed shape. In the illustrations shown, this would be the character shown in FIG. 9 or FIG. 12. The next pair of characters is then obtained and shape modification performed thereon. This is the character shown in FIG. 8 or FIG. 14. The two characters shown in FIG. 8 and 9 are then juxtaposed in the relation dictated by the shape operator with the resulting composite character shown in FIG. 10.

Figure 12:
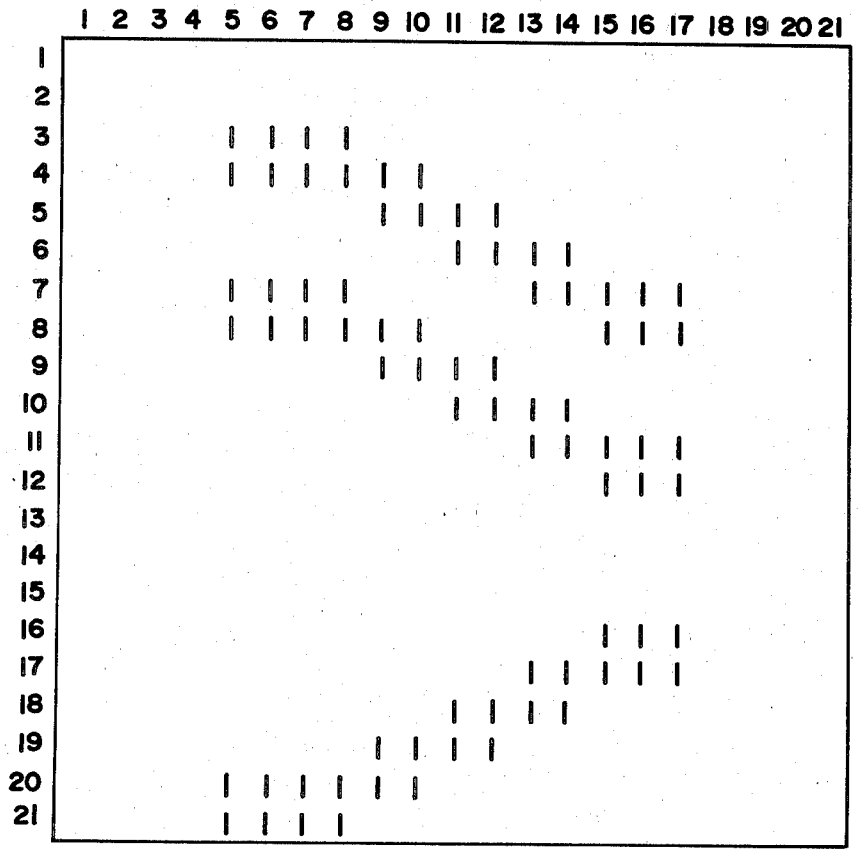
FIGS. 12, 13, and 14 are still further representations of ideograms as outputted in a dot matrix.
Figure 13:
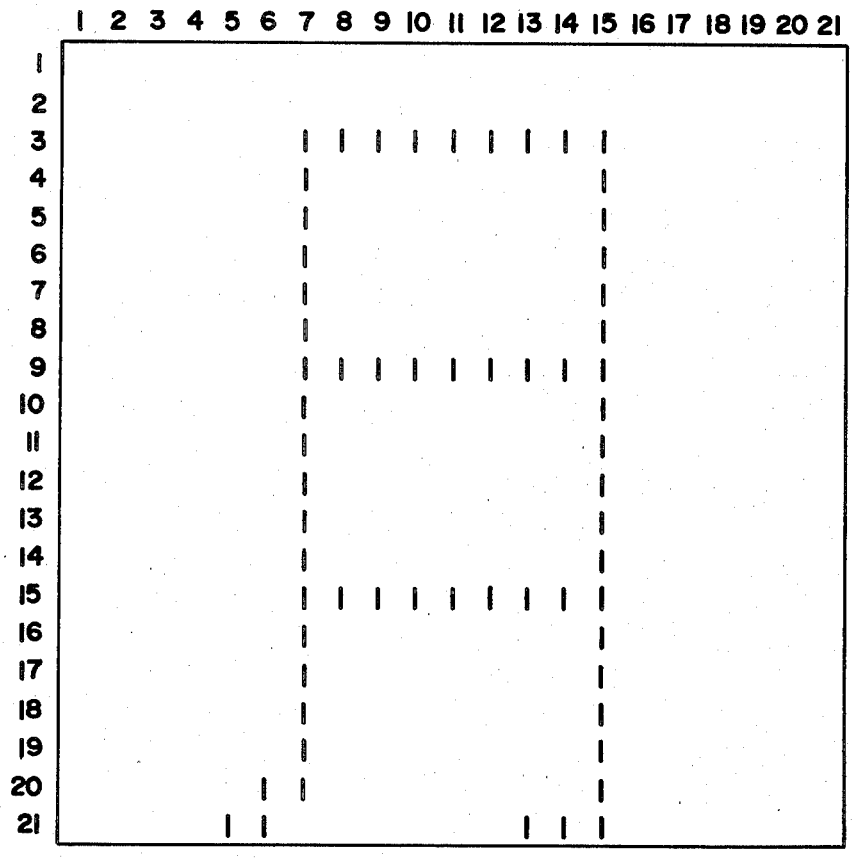
Figure 14:
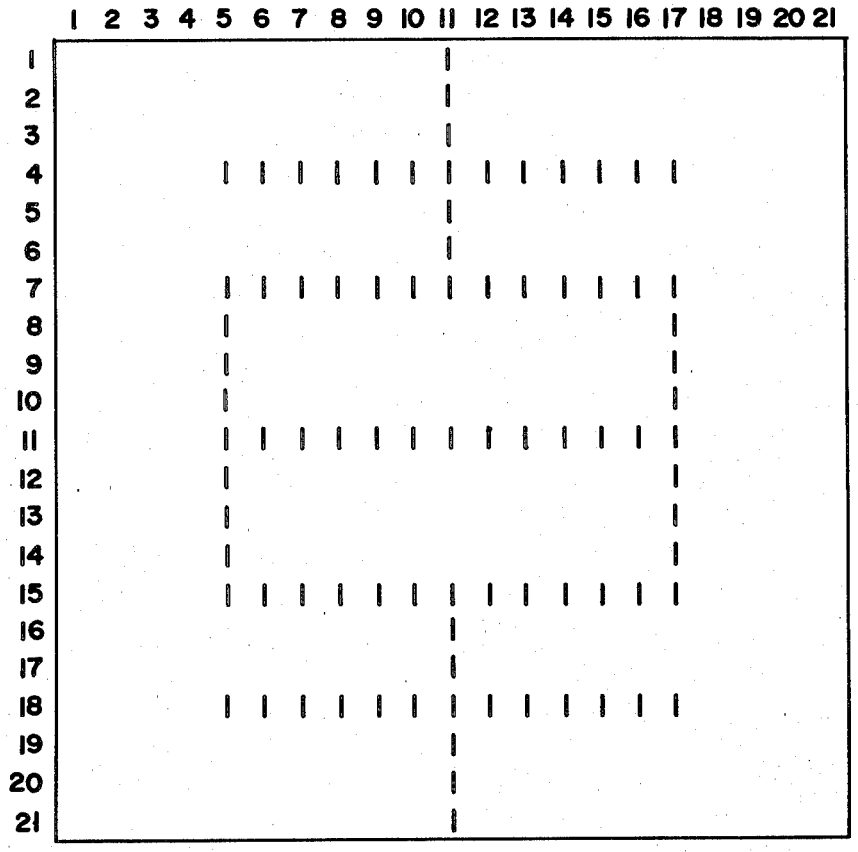

In the other example, FIG. 13 is compressed and the resulting composite of FIG. 12 which represents the character for "water," FIG. 14 which is a phonogram indicating a pronunciation, and FIG. 13 which is the character for "moon" are combined to form the composite character for "tide." For clarity, Tables 9, 10, and 11 are the bit maps for FIGS. 12, 13, and 14 respectively;

TABLE 9

| ML Hexidecimal Representation | Binary Representation | | | | | | | | Remarks | Rows |
|---|---|---|---|---|---|---|---|---|---|---|
| 40 | 0 | 1 | 0 | 0 | 0 | 0 | 0 | 0 | single byte - all 0's - one repeat | 1–2 |
| A1 | 1 | 0 | 1 | 0 | 0 | 0 | 0 | 1 | triple byte - no repeat | 3 |
| E0 | 1 | 1 | 1 | 0 | 0 | 0 | 0 | 0 | | |
| 00 | 0 | 0 | 0 | 0 | 0 | 0 | 0 | 0 | | |
| A1 | 1 | 0 | 1 | 0 | 0 | 0 | 0 | 1 | triple byte - no repeat | 4 |
| F8 | 1 | 1 | 1 | 1 | 1 | 0 | 0 | 0 | | |
| 00 | 0 | 0 | 0 | 0 | 0 | 0 | 0 | 0 | | |

TABLE 9-continued

| ML Hexidecimal Representation | Binary Representation | | | | | | | | Remarks | Rows |
|---|---|---|---|---|---|---|---|---|---|---|
| A0 | 1 | 0 | 1 | 0 | 0 | 0 | 0 | 0 | triple byte - no repeat | 5 |
| 1E | 0 | 0 | 0 | 1 | 1 | 1 | 1 | 0 | | |
| 00 | 0 | 0 | 0 | 0 | 0 | 0 | 0 | 0 | | |
| A0 | 1 | 0 | 1 | 0 | 0 | 0 | 0 | 0 | triple byte - no repeat | 6 |
| 07 | 0 | 0 | 0 | 0 | 0 | 1 | 1 | 1 | | |
| 80 | 1 | 0 | 0 | 0 | 0 | 0 | 0 | 0 | | |
| A1 | 1 | 0 | 1 | 0 | 0 | 0 | 0 | 1 | triple byte - no repeat | 7 |
| E1 | 1 | 1 | 1 | 0 | 0 | 0 | 0 | 1 | | |
| F0 | 1 | 1 | 1 | 1 | 0 | 0 | 0 | 0 | | |
| A1 | 1 | 0 | 1 | 0 | 0 | 0 | 0 | 1 | triple byte - no repeat | 8 |
| F8 | 1 | 1 | 1 | 1 | 1 | 0 | 0 | 0 | | |
| 70 | 0 | 1 | 1 | 1 | 0 | 0 | 0 | 0 | | |
| A0 | 1 | 0 | 1 | 0 | 0 | 0 | 0 | 0 | triple byte - no repeat | 9 |
| 1E | 0 | 0 | 0 | 1 | 1 | 1 | 1 | 0 | | |
| 00 | 0 | 0 | 0 | 0 | 0 | 0 | 0 | 0 | | |
| A0 | 1 | 0 | 1 | 0 | 0 | 0 | 0 | 0 | triple byte - no repeat | 10 |
| 07 | 0 | 0 | 0 | 0 | 0 | 1 | 1 | 1 | | |
| 80 | 1 | 0 | 0 | 0 | 0 | 0 | 0 | 0 | | |
| A0 | 1 | 0 | 1 | 0 | 0 | 0 | 0 | 0 | triple byte - no repeat | 11 |
| 01 | 0 | 0 | 0 | 0 | 0 | 0 | 0 | 1 | | |
| F0 | 1 | 1 | 1 | 1 | 0 | 0 | 0 | 0 | | |
| 39 | 0 | 0 | 1 | 1 | 1 | 0 | 0 | 1 | single byte - cols. 15–17 | 12 |
| 60 | 0 | 1 | 1 | 0 | 0 | 0 | 0 | 0 | single byte - all 0's - 2 repeats | 13–15 |
| 39 | 0 | 0 | 1 | 1 | 1 | 0 | 0 | 1 | single byte - cols. 15–17 | 16 |
| A0 | 1 | 0 | 1 | 0 | 0 | 0 | 0 | 0 | triple byte | 17 |
| 01 | 0 | 0 | 0 | 0 | 0 | 0 | 0 | 1 | | |
| F0 | 1 | 1 | 1 | 1 | 0 | 0 | 0 | 0 | | |
| A0 | 1 | 0 | 1 | 0 | 0 | 0 | 0 | 0 | triple byte | 18 |
| 07 | 0 | 0 | 0 | 0 | 0 | 1 | 1 | 1 | | |
| 80 | 1 | 0 | 0 | 0 | 0 | 0 | 0 | 0 | | |
| A0 | 1 | 0 | 1 | 0 | 0 | 0 | 0 | 0 | | 19 |
| 1E | 0 | 0 | 0 | 1 | 1 | 1 | 1 | 0 | | |
| 00 | 0 | 0 | 0 | 0 | 0 | 0 | 0 | 0 | | |
| A1 | 1 | 0 | 1 | 0 | 0 | 0 | 0 | 1 | triple byte - no repeat | 20 |
| F8 | 1 | 1 | 1 | 1 | 1 | 0 | 0 | 0 | | |
| 00 | 0 | 0 | 0 | 0 | 0 | 0 | 0 | 0 | | |
| A1 | 1 | 0 | 1 | 0 | 0 | 0 | 0 | 1 | triple byte - no repeat | 21 |
| E0 | 1 | 1 | 1 | 0 | 0 | 0 | 0 | 0 | | |
| 00 | 0 | 0 | 0 | 0 | 0 | 0 | 0 | 0 | | |

TABLE 10

| =< Hexidecimal Representation | Binary Representation | | | | | | | | Remarks | Rows |
|---|---|---|---|---|---|---|---|---|---|---|
| 40 | 0 | 1 | 0 | 0 | 0 | 0 | 0 | 0 | single byte - one repeat - all 0's | 1–2 |
| 23 | 0 | 0 | 1 | 0 | 0 | 0 | 1 | 1 | single byte - no repeat - cols. 7–15 | 3 |
| 1F | 0 | 0 | 0 | 1 | 1 | 1 | 1 | 1 | double byte - more than 2 repeats | 4–8 |
| 21 | 0 | 0 | 1 | 0 | 0 | 0 | 0 | 1 | cols. 7, 15 - 4 repeats | |
| 23 | 0 | 0 | 1 | 0 | 0 | 0 | 1 | 1 | single byte - no repeat - cols. 7–15 | 9 |
| 1F | 0 | 0 | 0 | 1 | 1 | 1 | 1 | 1 | double byte - more than 2 repeats | 10–14 |
| 21 | 0 | 0 | 1 | 0 | 0 | 0 | 0 | 1 | cols. 7, 15 - 4 repeats | |
| 23 | 0 | 0 | 1 | 0 | 0 | 0 | 1 | 1 | single byte - no repeat - cols. 7–15 | 15 |

TABLE 10-continued

| =< Hexidecimal Representation | Binary Representation | | | | | | | | Remarks | Rows |
|---|---|---|---|---|---|---|---|---|---|---|
| 1F | 0 | 0 | 0 | 1 | 1 | 1 | 1 | 1 | double byte - more than 2 repeats | 16–19 |
| 2F | 0 | 0 | 1 | 0 | 1 | 1 | 1 | 1 | cols. 7, 15 - 3 repeats | |
| A0 | 1 | 0 | 1 | 0 | 0 | 0 | 0 | 0 | triple byte | 20 |
| C0 | 1 | 1 | 0 | 0 | 0 | 0 | 0 | 0 | | |
| 40 | 0 | 1 | 0 | 0 | 0 | 0 | 0 | 0 | | |
| A1 | 1 | 0 | 1 | 0 | 0 | 0 | 0 | 1 | triple byte | 21 |
| 81 | 1 | 0 | 0 | 0 | 0 | 0 | 0 | 1 | | |
| C0 | 1 | 1 | 0 | 0 | 0 | 0 | 0 | 0 | | |

TABLE 11

| 0L Hexidecimal Representation | Binary Representation | | | | | | | | Remarks | Rows |
|---|---|---|---|---|---|---|---|---|---|---|
| 02 | 0 | 0 | 0 | 0 | 0 | 0 | 1 | 0 | double byte - 2 repeats | 1–3 |
| 60 | 0 | 1 | 1 | 0 | 0 | 0 | 0 | 0 | col. 11 | |
| 07 | 0 | 0 | 0 | 0 | 0 | 1 | 1 | 1 | double byte - cols. 5–17 | 4 |
| 0E | 0 | 0 | 0 | 0 | 1 | 1 | 1 | 0 | rule exception | |
| 01 | 0 | 0 | 0 | 0 | 0 | 0 | 0 | 1 | double byte - one | 5–6 |
| 60 | 0 | 1 | 1 | 0 | 0 | 0 | 0 | 0 | repeat - col. 11 | |
| 27 | 0 | 0 | 1 | 0 | 0 | 1 | 1 | 1 | single byte - no repeat - cols. 5–17 | 7 |
| 02 | 0 | 0 | 0 | 0 | 0 | 0 | 1 | 0 | double byte - 2 repeats | 8–10 |
| A0 | 0 | 1 | 0 | 0 | 0 | 0 | 0 | 0 | cols. 5, 17 | |
| 27 | 0 | 0 | 1 | 0 | 0 | 1 | 1 | 1 | single byte - no repeat - cols. 5–17 | 11 |
| 02 | 0 | 0 | 0 | 0 | 0 | 0 | 1 | 0 | double byte - 2 repeats | 12–14 |
| 40 | 0 | 1 | 0 | 0 | 0 | 0 | 0 | 0 | cols. 7, 15 | |
| 27 | 0 | 0 | 1 | 0 | 0 | 1 | 1 | 1 | single byte - no repeat - cols. 5–17 | 15 |
| 01 | 0 | 0 | 0 | 0 | 0 | 0 | 0 | 1 | double byte - one | 16–17 |
| 60 | 0 | 1 | 1 | 0 | 0 | 0 | 0 | 0 | repeat - col. 11 | |
| 07 | 0 | 0 | 0 | 0 | 0 | 1 | 1 | 1 | double byte - cols. 5–17 | 18 |
| 0E | 0 | 0 | 0 | 0 | 1 | 1 | 1 | 0 | rule exception | |
| 02 | 0 | 0 | 0 | 0 | 0 | 0 | 1 | 0 | double byte - 2 repeats - | 19–21 |
| 60 | 0 | 1 | 1 | 0 | 0 | 0 | 0 | 0 | col. 11 | |

Further, using the present system with the shape operators shown in FIG. 11, the inputted coded data sequence to form the character shown in FIG. 15 is 4$MLOL=<. Reference to Appendix 1 will show the individual characters before development. Should there be additional shape operations, additional pairs in the hierarchical string are obtained and the additional shape operations performed. Finally, the outputted two-dimensional shape is displayed on the output device.

It is also useful to provide to the user the inputted character string during the development of the desired character. Since this function is well known in the art, further discussion is not necessary.

It should be understood that this system is usable by individuals generally familiar with the character set associated therewith. This does not necessarily require a knowledge of the language itself since, for example, the user can refer to the characters displayed in Appendix 1 using either the characters contained therein or develop the combined character sets from the components set forth in Appendix 1. It should further be understood that the components shown in Appendix 1 do not necessarily represent words or phrases in the Oriental languages, but rather, constitute commonly found components in other characters of the Oriental languages. Of course, as illustrated above, certain characters are multiples of the components already in Appendix 1. Of course, additional characters can be made available by the user. In the Oriental character set, these could include Korean and Japanese symbols. With the present character set represented by the matrix attached as Appendix 1, it has been found that on the average, one of the upwards of 50,000 different characters normally used in Chinese textual materials and available in this system can be generated with three to four key strokes. The minimum, of course, is two key strokes with the maximum being limited by the number of shape operations to be performed. This invention, while only using three shape operations could include additional shapes. With three shape operations, the operator would key eleven key strokes. (See Table 7.)

It is envisioned that this system is usable to store and retrieve information in an hierarchical set such as the Oriental character set. It is further useful in the transmission of data in Oriental characters from one point to another. For example, a user at location A can key in on a standard keyboard or the like the coded character strings necessary to develop Oriental characters or other hierarchical characters as the case may be, for transmission to location B. At location B, the coded character strings are reconstructed into the characters of the hierarchical character set for display on an output device at location B. Furthermore, the system can be used for establishing an hierarchical order or characters for storage and retrieval at some later date. It should be understood that the ordering of the character set in Appendix 1, while not arbitrary, could be changed to other schemes as set forth in the background of this invention, without losing the spirit of this invention. It should further be understood that the particulars of the juxtaposition of the characters, that is, which rows and columns are removed during the combination of the characters, is illustrative. Although the scheme set forth herein is desirable, other schemes and arrangements can be utilized without departing from the spirit of this invention.

What is claimed is:

1. In a computer display system including input means for receiving coded sequences of signals, processor means for storing a control program, output means responsive to said control program and said coded sequence of said signals for displaying two-dimensional shapes, storage means for hierarchically storing a set of ideograms, and means responsive to one of said coded sequences for controlling said storage means to provide to the said output means for display thereon one of said ideograms in a predetermined space; the improvement comprising:

reduction means responsive to said control program for selectively reducing at least one dimension of at

Appendix 1

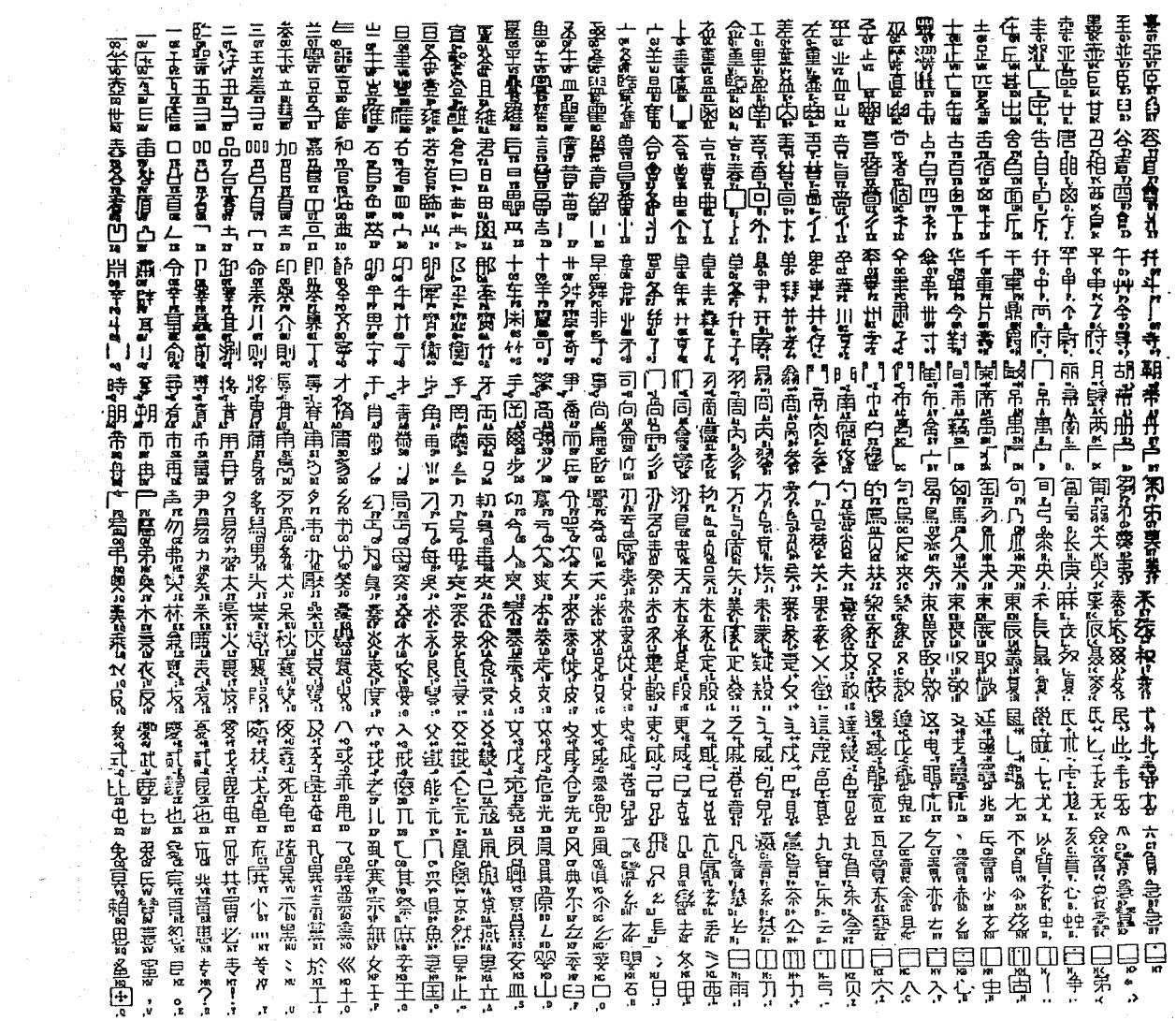

least one of said ideograms by selecting pixels in said one ideogram which may be omitted while retaining the intelligence associated with the ideogram;

position means responsive to said control program for placing said one reduced ideogram adjacent a second ideogram for simultaneous display on said output means in the same predetermined space.

2. The improved system of claim 1 further including means for expanding one of said ideograms into an "n" row by "n" column matrix of binary digits.

3. The improved system of claim 2 wherein the reduction means comprises means for eliminating at least one predetermined row of said "n" row by "n" column matrix.

4. The system of claim 2 wherein the reduction means comprises means for eliminating at least one predetermined column of said "n" row by "n" column matrix.

5. The system of claim 1 wherein said output means displays two-dimensional shapes in an "n" by "n" dot matrix, and further wherein the reduced ideogram and the second ideogram can be displayed within an "n" by "n" dot matrix.

6. The system of claim 5 wherein said storage means stores in ideogram in less than "n" times "n" binary digits.

7. The improved system of claim 6 further including means for expanding one of said stored ideograms from less than "n" times "n" binary digits to "n" times "n" binary digits.

8. The system of claim 1 wherein said coded sequence of signals includes signals directing at least one reduction of at least one of said ideograms, the improvement further including decision means for separating said reduction signals from signals representing an ideogram.

9. A computer display system:

comprising input means for receiving coded sequences of signals;

processor means for storing a control program;

output means responsive to said control program for displaying two-dimensional shapes;

storage means for hierarchically storing a set of ideograms;

means responsive to one of said coded sequences for providing to said output means for display thereon in a predetermined space one of said ideograms;

reduction means responsive to said control program for selectively reducing at least one dimension of at least one of said ideograms by selecting pixels in said one ideogram which may be omitted while retaining the intelligence associated with the ideogram;

position means responsive to said control program for placing said one reduced ideogram adjacent a second ideogram for simultaneously displaying on said output means in the same predetermined space.

10. The improved system of claim 9 further including means for expanding said ideogram into an "n" row by "n" column matrix of binary digits.

11. The improved system of claim 10 wherein the reduction means comprises means for eliminating at least one predetermined column of said "n" row by "n" column matrix.

12. The system of claim 10 wherein the reduction means comprises means for eliminating at least one predetermined row of said "n" row by "n" column matrix.

13. The system of claim 9 wherein said output means displays two-dimensional shapes in an "n" by "n" dot matrix, and further wherein the reduced ideogram and the second ideogram can be displayed within an "n" by "n" dot matrix.

14. The system of claim 13 wherein said storage means stores an ideogram in less than "n" times "n" binary digits.

15. The improved system of claim 14 further including means for expanding one of said stored ideograms from less than "n" times "n" binary digits to "n" times "n" binary digits.

16. The system of claim 9 wherein said coded sequence of signals includes signals directing at least one reduction of at least one of said ideograms, the improvement further including decision means for separating said reduction signals from signals representing an ideograph.

17. A method for generating an ideogram of a given size for display on an output device of a computer system comprising the steps of:

a. inputting a coded character string;

b. checking the character string to determine if it represents a combination of more than two ideograms each of said given size, thereby requiring shape modification;

c. determining what shape modification is required on each ideogram;

d. modifying the shape of the ideogram by selective removal of portions of that ideogram;

e. juxtaposing the modified shapes one adjacent the other; and f. displaying said juxtaposed characters in a visual manner in a space equal to said given size.

18. The method set forth in claim 17 further including a step following step (a). of converting the inputted character string to a second coded character string having a hierarchical order.

19. The method set forth in claim 18 further including a step between step b. and step c. of developing an "n" by "n" matrix representing each ideogram from information contained in the second coded character string.

20. The method set forth in claim 19 wherein the step of modifying the shape of an ideogram comprises the step of removing selected clumns.

21. The method set forth in claim 19 wherein the step of modifying the shape of an ideogram comprises the step of removing selected rows.

* * * * *

UNITED STATES PATENT AND TRADEMARK OFFICE

CERTIFICATE OF CORRECTION

PATENT NO. : 4,408,199

DATED : October 4, 1983

INVENTOR(S) : Douglass A. White, Susan J. Moore and David F. Clark

It is certified that error appears in the above—identified patent and that said Letters Patent is hereby corrected as shown below:

Column 1, Line 25, after "These" insert --five--.
Column 5, Line 5, after "10" delete "is" and insert --in--.
Column 5, Line 65, delete "eight" and insert --eighth--.
Column 6, Line 36, delete "horizontial" and insert --horizontal-.
Column 8, Table 1, Line 42, before "rule exception" should read --X X X X 1 1 1 0--.
Column 13, Table 5, Line 43, "13-14" should be under "Remarks".
Column 16, Table 7a, Line 3, after "shape 1" beginning under column 6 should be --1, 3, 4, 5, 7, 8, 9, 10, 11, 13, 14, 15, 17, 18, 19, 21--.
Column 16, Table 7a, Line 7, delete "§a" and insert --$a--.
Column 16, Table 7a, Line 21, delete "§b" and insert --$b--.
Column 20, Line 1, delete "Exampoles" and insert --Examples--.
Column 27, Line 26, after "stores" delete "in" and insert --an--.

Signed and Sealed this

*Third* Day of *April 1984*

[SEAL]

*Attest:*

GERALD J. MOSSINGHOFF

*Attesting Officer*

*Commissioner of Patents and Trademarks*